US008768184B2

(12) United States Patent
Ishida

(10) Patent No.: US 8,768,184 B2
(45) Date of Patent: Jul. 1, 2014

(54) IMAGE FORMING APPARATUS WITH DEVELOPING DEVICE, SENSOR, AND CONTROLLER

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 13/314,489

(22) Filed: Dec. 8, 2011

(65) Prior Publication Data

US 2012/0155892 A1 Jun. 21, 2012

(30) Foreign Application Priority Data

Dec. 17, 2010 (JP) ..... 2010-281487

(51) Int. Cl.
*G03G 15/08* (2006.01)

(52) U.S. Cl.
USPC ..... 399/27; 399/29; 399/53

(58) Field of Classification Search
USPC ..... 399/53, 27, 28, 29, 55, 56, 222, 236, 399/252, 253, 265
See application file for complete search history.

(56) References Cited

U.S. PATENT DOCUMENTS

| | | | | |
|---|---|---|---|---|
| 5,005,517 | A | 4/1991 | Fukui et al. | |
| 5,778,279 | A * | 7/1998 | Kawai et al. | 399/42 |
| 6,137,977 | A | 10/2000 | Okado et al. | |
| 6,785,482 | B2 | 8/2004 | Ogata et al. | |
| 7,164,868 | B2 | 1/2007 | Ishida | |
| 7,831,159 | B2 | 11/2010 | Ishida | |
| 2002/0005887 | A1 | 1/2002 | Nakase et al. | |
| 2003/0175040 | A1 | 9/2003 | Ogata et al. | |
| 2006/0127133 | A1 | 6/2006 | Suzuki | |
| 2007/0286643 | A1 | 12/2007 | Kinokuni | |
| 2008/0285993 | A1 | 11/2008 | Ishida | |
| 2010/0316401 | A1 | 12/2010 | Gomi | |

FOREIGN PATENT DOCUMENTS

| | | | | |
|---|---|---|---|---|
| EP | 886186 | B1 | 11/2003 | |
| EP | 1367455 | A2 | 12/2003 | |
| JP | 08030101 | A * | 2/1996 | G03G 15/08 |
| JP | 2002-31954 | A | 1/2002 | |
| JP | 2002-268367 | A | 9/2002 | |
| JP | 2004-226658 | A | 8/2004 | |
| JP | 2006-47885 | A | 2/2006 | |
| JP | 2007-171573 | A | 7/2007 | |
| JP | 2008-145522 | A | 6/2008 | |
| JP | 2010-175960 | A | 8/2010 | |

OTHER PUBLICATIONS

Office Action dated Feb. 19, 2013, in Russian Application No. 2011151542128 (077431).

(Continued)

*Primary Examiner* — Billy Lactaoen
(74) *Attorney, Agent, or Firm* — Fitzpatrick, Cella, Harper & Scinto

(57) ABSTRACT

An image forming apparatus includes an image bearing member, a developing device for developing an electrostatic latent image including a developer and a developer carrying member, a sensor for detecting information related to a toner charge amount of the developer, and a controller. An image forming period has a first period and a second period, during which different modes are executed by the controller to provide for a lower speed of the developer carrying member in the first period than in the second period. The controller is capable of executing an operation that lowers the potential difference between a non-image-forming portion of the image bearing member and the developing bias applied to the developer carrying member based on detection results of the sensor.

18 Claims, 23 Drawing Sheets

(56) References Cited

OTHER PUBLICATIONS

Notification of the First Office Action dated Mar. 22, 2013, in Chinese Application No. 201110421728.8.

Combined Search and Examination Report under Sections 17 and 18(3) dated Apr. 17, 2012, in Great Britain Application No. GB1121699.1.

* cited by examiner

IMAGE FORMING APPARATUS WITH DEVELOPING DEVICE, SENSOR, AND CONTROLLER

FIELD OF THE INVENTION AND RELATED ART

The present invention relates to an image forming apparatus, such as a copying machine or a laser beam printer, which employs an electrostatic recording method or an electrophotographic image forming method, in which an electrostatic latent image formed on an image bearing member is developed with a two-component developer including a toner and a carrier.

Generally, an electrophotographic image forming apparatus effects image formation by respective image forming processes of charging, exposure, development, transfer, fixing, and cleaning. That is, after the surface of an electrophotographic photosensitive member (hereinafter referred to as "photosensitive member") is uniformly charged, an electrostatic latent image is formed by performing image exposure depending on image information. This is electrostatic latent image is developed into a toner image with the toner, and the toner image is transferred from the photosensitive member onto a recording material (medium) such as paper. After the transfer of the toner image, the photosensitive member is cleaned by removing a transfer residual toner remaining on the surface of the photosensitive member. On the other hand, the recording material onto which the toner image is transferred is subjected to heat and pressure, so that the toner image is fixed on the surface of the recording material. As a result, the image formation is ended.

In a conventional electrophotographic image forming apparatus, particularly in the image forming apparatus for forming a color image, a two-component developing method in which a non-magnetic toner and a magnetic carrier are mixed and used as the developer has been widely used. The two-component developing method has, compared with currently known other developing methods, the advantages of image quality stability, durability of the image forming apparatus, and the like.

In the image forming apparatus using the two-component developing method, in the case where the electrostatic latent image formed on the photosensitive drum (photosensitive member) as the image bearing member is developed into the toner image, the development is generally effected in the following manner. First, the surface of the photosensitive drum is uniformly charged to a white background portion (non-image portion) potential Vd by a charging means. Further, to a developing sleeve as a developer carrying member, a developing bias is applied, so that the developing sleeve has the same potential as that of a DC component Vdc of the developing bias. At this time, a potential difference between the white background portion potential Vd and the DC component Vdc of the developing bias is set so as to be equal to a desired fog-removing potential difference Vback.

Further, an image portion (developed portion) on the photosensitive drum has a light portion potential Vl of the light exposure with an exposure means (electrostatic latent image forming means). Then, by a contrast potential difference which is a difference between the light portion potential Vl and the DC component Vdc of the developing bias, the toner on the developing sleeve is moved onto the photosensitive drum. Thus, the electrostatic latent image formed on the photosensitive drum is developed into the toner image.

For example, in the case of using a negative toner charged to a negative (−) polarity, the DC component Vdc of the developing bias is set to have a potential which is positive relative to the white background potential Vd. Further, the negative toner is prevented from being deposited on the photosensitive drum at the white background portion where naturally the toner should not be deposited, thus preventing an occurrence of "fog". Hereinafter, the toner deposited at the white background portion is referred to as "fog toner".

In the case where the fog-removing potential difference Vback is small, a toner attracting force to the developing sleeve becomes weak, so that the fog toner is liable to deposit on the photosensitive drum at the white background portion. On the other hand, in the case where the fog-removing potential difference Vback is large, the toner is negatively charged, so that the Coulomb force, by the fog-removing potential difference, exerted on the positively charged magnetic carrier is larger than a magnetic (force) carrying force with the developing sleeve. Then, the carrier is liable to deposit on the photosensitive drum at the white background portion. Therefore, the fog-removing potential difference Vback is set at a proper potential difference depending on a magnetic flux density of a developing pole of the developing sleeve and toner and carrier characteristics.

However, in the image forming apparatus using the two-component developing method, there arose the following problems. In recent years, during realization of various functions, at a main assembly side of the image forming apparatus, functions such as a so-called inserting paper function such that paper different in size or type is inserted, and, as a post-process function, a bookbinding function of inserting the front or back cover, cutting, and using paste or a stapler are added.

A combined instruction of some of these processes is inputted from an operating portion and during its job, there arises a need to await subsequent print start in a state in which a time of an interval (sheet interval) between adjacent printing operations is increased and the printing is not effected. Further, at the sheet interval, an image forming unit, having the functions of the charging, the developing and the cleaning, of the image forming apparatus main assembly is in a stand-by state while performing an idling operation as shown in (a) of FIG. 27.

Incidentally, each of (a), (b) and (c) of FIG. 27 shows a time axis (abscissa) of ON/OFF, from above, of each of drive of the photosensitive drum, a charging bias, the developing sleeve and a developer stirring member.

In (A) of FIG. 27, also in a sheet interval, similarly as during image formation, the photosensitive drum, the developing sleeve and the developer stirring member are driven. As a result, abrasion of a cleaning blade by contact rotation with the photosensitive drum and developer deterioration by developer stirring are accelerated and correspondingly on image quality deterioration and a decrease of a developer lifetime proceed.

Therefore, as shown in (B) of FIG. 27, in the case where a time of the sheet interval between image forming operations is larger than a certain (predetermined) time, a structure in which the drive of the developing sleeve, the developer stirring member and the photosensitive drum is temporarily stopped is proposed (Japanese Laid-Open Patent Application (JP-A) 2007-171573).

Incidentally, a structure for suppressing the toner deposition on the developing sleeve surface by making the fog-removing potential difference Vback during the sheet interval lower than that during the image formation is proposed (JP-A 2006-47885).

In the case of the structure described in JP-A 2007-171573, a time for which the drive of the members is once stopped in the sheet interval, a raising operation at the time of starting the drive again and raising and falling of high voltages for charging and developing are required. For this reason, in the case where the sheet interval is short, a subsequent print start time is correspondingly delayed, so that productivity is lowered.

Therefore, as shown in (c) of FIG. 27, in the case where the time of the sheet interval is in a certain range, within a range in which the productivity is not sacrificed, it would be considered that only the drive of the developer stirring member is stopped and other image forming system units are operated similarly as during normal image formation.

However, in the schematic view in the case of (C) of FIG. 27, a relationship between the potential of the photosensitive drum and the potential of the developing sleeve is continued in the state of the fog-removing potential difference Vback. For that reason, the negative toner in the developer is urged toward the developing sleeve with a move positive potential. Further, in the case of using the two-component developing method, by the fog-removing potential difference Vback in a non-image formation area, the toner is not formed on the developing sleeve as an erected chain (magnetic brush) of the developer but is accumulated on the surface of the developing sleeve. That is, in the sheet interval (during non-developing operation), at the developing sleeve surface corresponding to an intimate contact position (developing nip position) between the developing sleeve and the photosensitive drum, such a state that a large amount of the toner is deposited is created.

When the amount of the toner deposited on the developing sleeve surface is increased, the negative toner which is charged to the negative polarity is an insulating material, and therefore an apparent potential at the developing sleeve surface is further negative (−) than a DC component Vdc of the developing bias. For that reason, when the electrostatic latent image is formed on the photosensitive drum in an image forming area, an apparent developing contract potential difference Vcont is increases, so that an image density is increased.

Thereafter, in the image forming area, when the toner deposited on the developing sleeve surface is consumed in a developing step, the surface potential of the developing sleeve is the same potential as that of the DC component Vdc of the developing bias. As a result, the developing contrast potential difference becomes normal, so that a desire image density is ensured.

Therefore, when the development for a halftone or solid image which consumes a large amount of the toner, in the above-described manner, only the image density at a portion corresponding to the portion of the developing sleeve on which the toner is deposited is increases, so that image defect such as lateral stripes or the like can occur.

For this reason, as in the structure described in JP-A 2006-47885, it would be considered that the fog-removing potential difference Vback in the sheet interval is made smaller than that during the image formation. However, as in the structure described in JP-A 2006-47885, when the fog-removing potential difference Vback is simply decreased, the toner deposition amount at the developing sleeve surface is fluctuated depending on a status of the use of the developer and therefore an effect is not sufficient in some cases. That is, when the fog-removing potential difference Vback is made excessively small depending on the developer status, fog occurs and when the fog-removing potential difference Vback is made excessively large, the amount of the toner deposited on the developing sleeve surface is increased and thus there are some cases where the toner is discharged more than necessary during the image formation.

According to study of the present inventor, it was discovered that such a phenomenon that the toner was deposited on the developing sleeve surface remarkably occurred in the case where a toner charge amount of the two-component developer was lowered. This may be attributable to a phenomenon that an electrical depositing force of the toner with the carrier is decreased by lowering of the toner charge amount, with the result that the toner is liable to be separated from the carrier by the fog-removing potential difference Vback. Incidentally, herein, the lowering of the toner charge amount means that an absolute value of the toner charge amount is lowered.

SUMMARY OF THE INVENTION

A principal object of the present invention is to provide, in view of the above circumstances, an image forming apparatus capable of suppressing an occurrence of image defect irrespective of a status of use of a developer.

According to an aspect of the present invention, there is provided an image forming apparatus comprising: an image bearing member; a developing device, including a developer carrying member for carrying a developer including a non-magnetic toner and a magnetic carrier and for conveying the developer to a developing position in which the developer carrying member opposes the image bearing member; detecting means for detecting information correlating to a toner charge amount of the developer in the developing device; and a controller capable of executing an operation in a mode wherein, during an image forming period in which an image is continuously formed on a plurality of recording materials, drive of the developer carrying member in a first period in which a non-image-formation area of the image bearing member corresponding to an internal between a recording material and a subsequent recording material passes through the developing position is stopped or lowered in speed less than that in a second period in which an image area corresponding to the recording material passes through the developing position, wherein the controller controls, on the basis of a detection result of the detecting means, the developing device so that the toner is less tending to be deposited on the developer carrying member, with a decrease of the toner charge amount, in the first period than in the second period during execution of the operation in the mode.

According to another aspect of the present invention, there is provided an image forming apparatus comprising: an image bearing member; a developing device, including a developer carrying member for carrying a developer including a non-magnetic toner and a magnetic carrier and for conveying the developer to a developing position in which the developer carrying member opposes the image bearing member; detecting means for detecting information correlating to a toner charge amount of the developer in the developing device; and a controller for controlling, on the basis of a detection result of the detecting means, the developing device so that the toner is, with a decrease of the toner charge amount, less tending to be deposited on the developer carrying member in a first period, in which a non-image-formation area passes through the developing position, than in a second period, in which an image area passes through the developing position, during execution of the operation in the mode.

These and other objects, features and advantages of the present invention will become more apparent upon a consideration of the following description of the preferred embodiments of the present invention taken in conjunction with the accompanying drawings.

Figure 6:
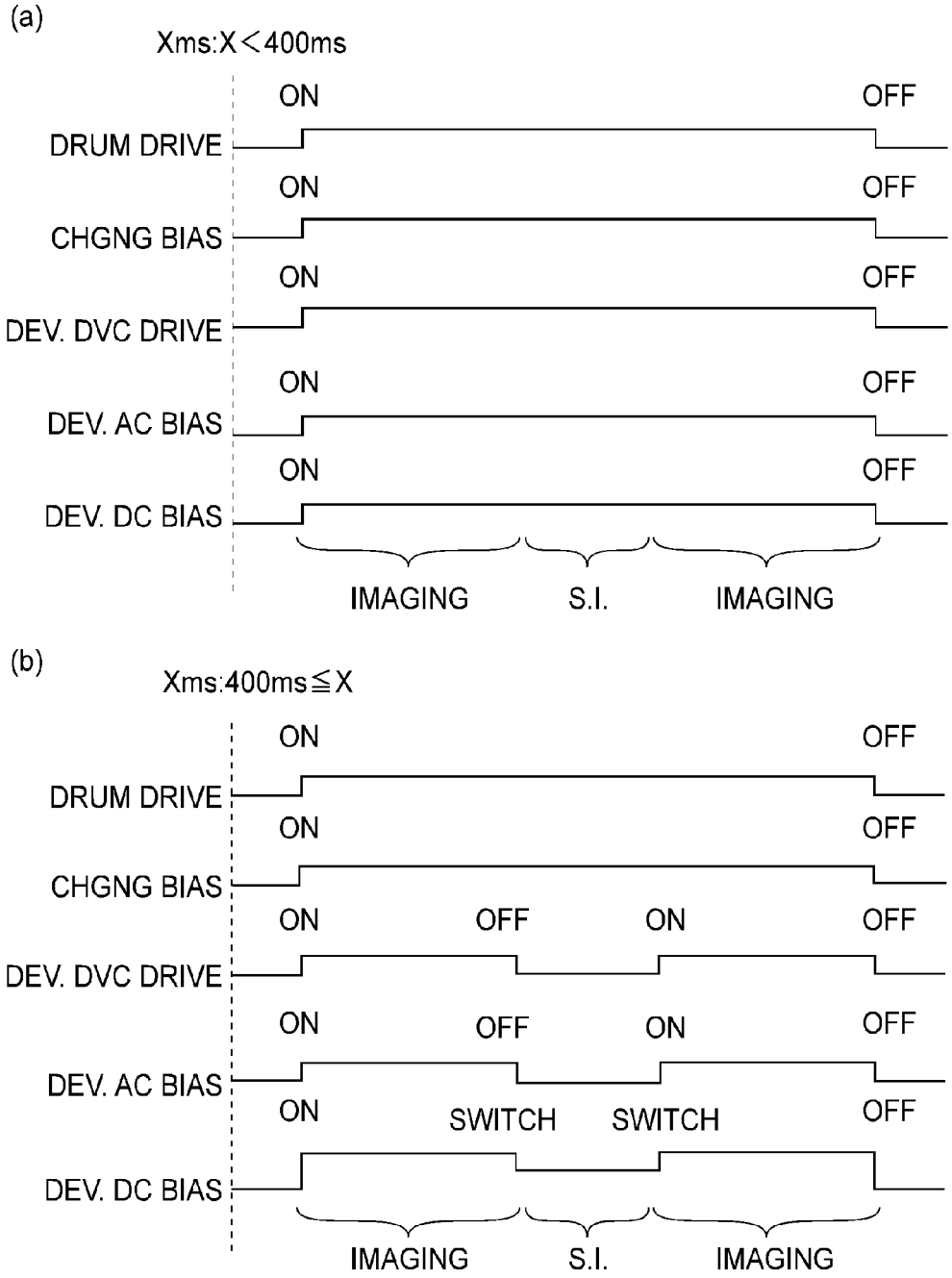

Parts (a) and (b) of FIG. 6 are time charts each showing operations of drive of a photosensitive drum, a charging bias, drive of a developing sleeve and a developer stirring and feeding screw, a developing AC bias and a developing DC bias, wherein (a) shows the case where a sheet interval time is less than a predetermined time, and (b) shows the case where the sheet interval time is not less than the predetermined time.

Figure 7:
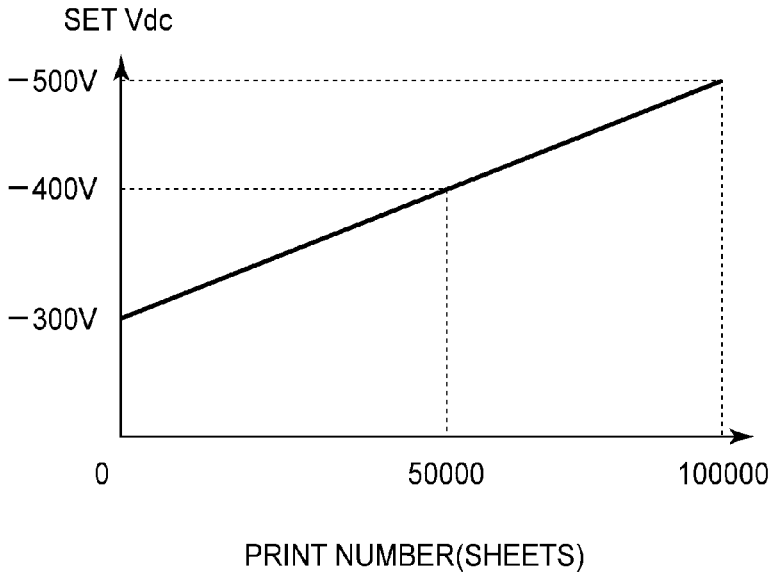

FIG. 7 is a graph showing a setting table of a developing bias in First Embodiment.

Figure 8:
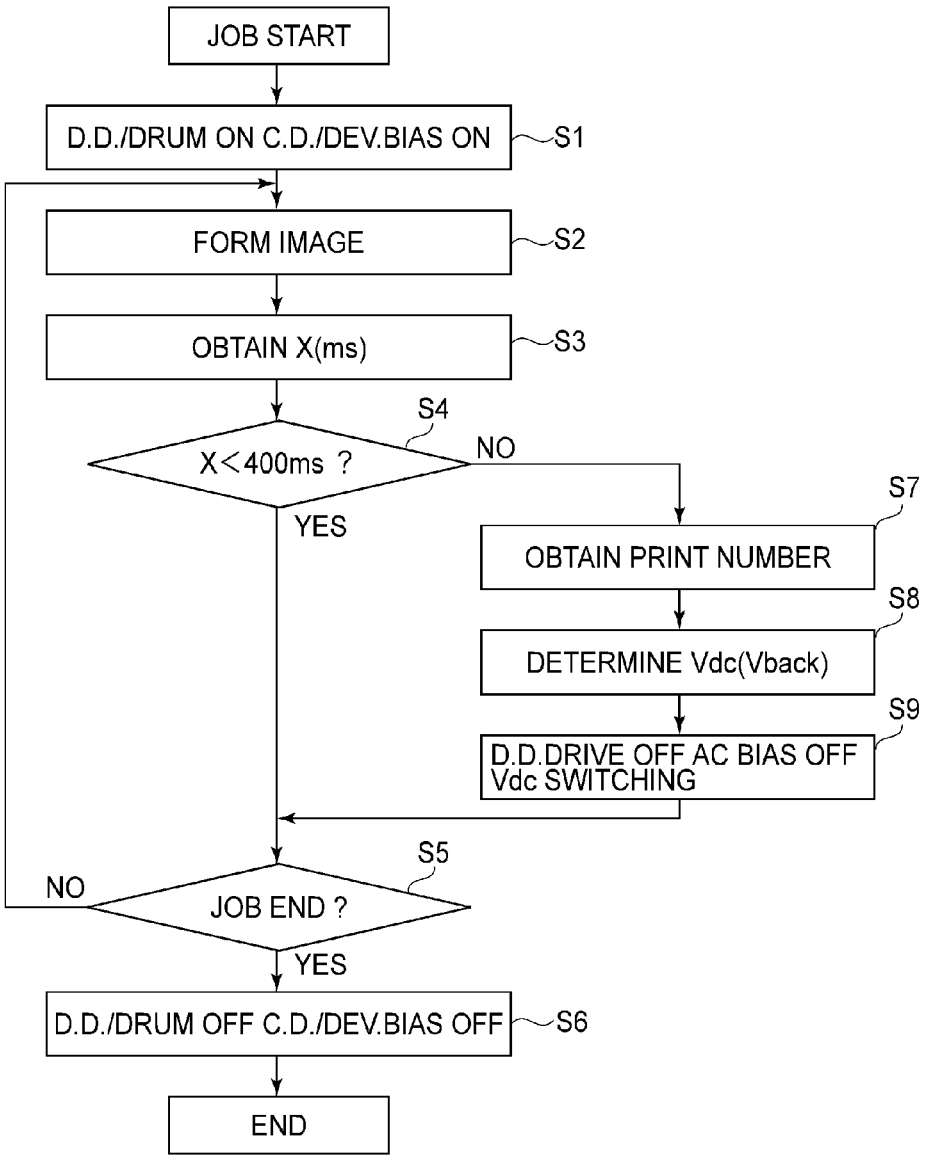

FIG. 8 is a flow chart in First Embodiment.

Figure 9:
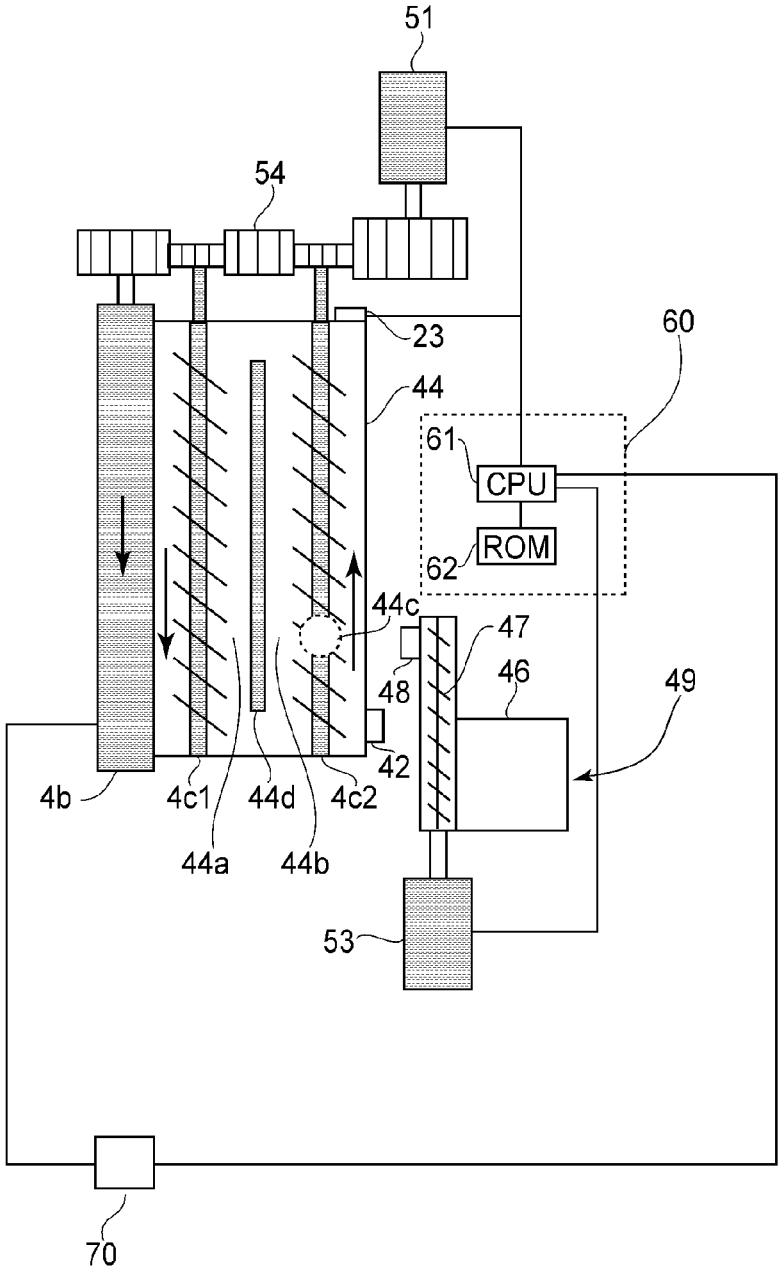

FIG. 9 is a schematic view of a developing device and a toner supplying device in Second Embodiment of the present invention.

Figure 10:
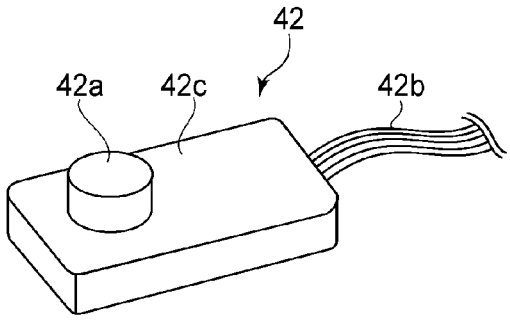

FIG. 10 is a schematic perspective illustration of a magnetic permeability sensor used in Second Embodiment.

Figure 11:
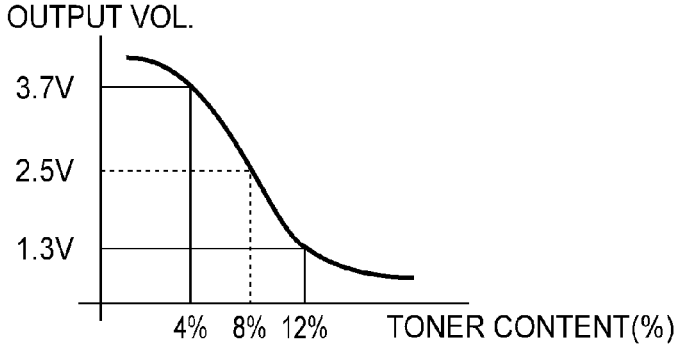

FIG. 11 is a graph showing an output characteristic of the magnetic permeability sensor.

Figure 12:
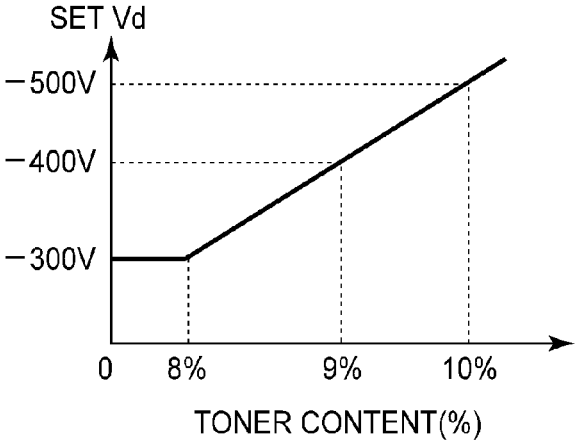

FIG. 12 is a graph showing a setting table of a developing bias in Second Embodiment.

Figure 13:
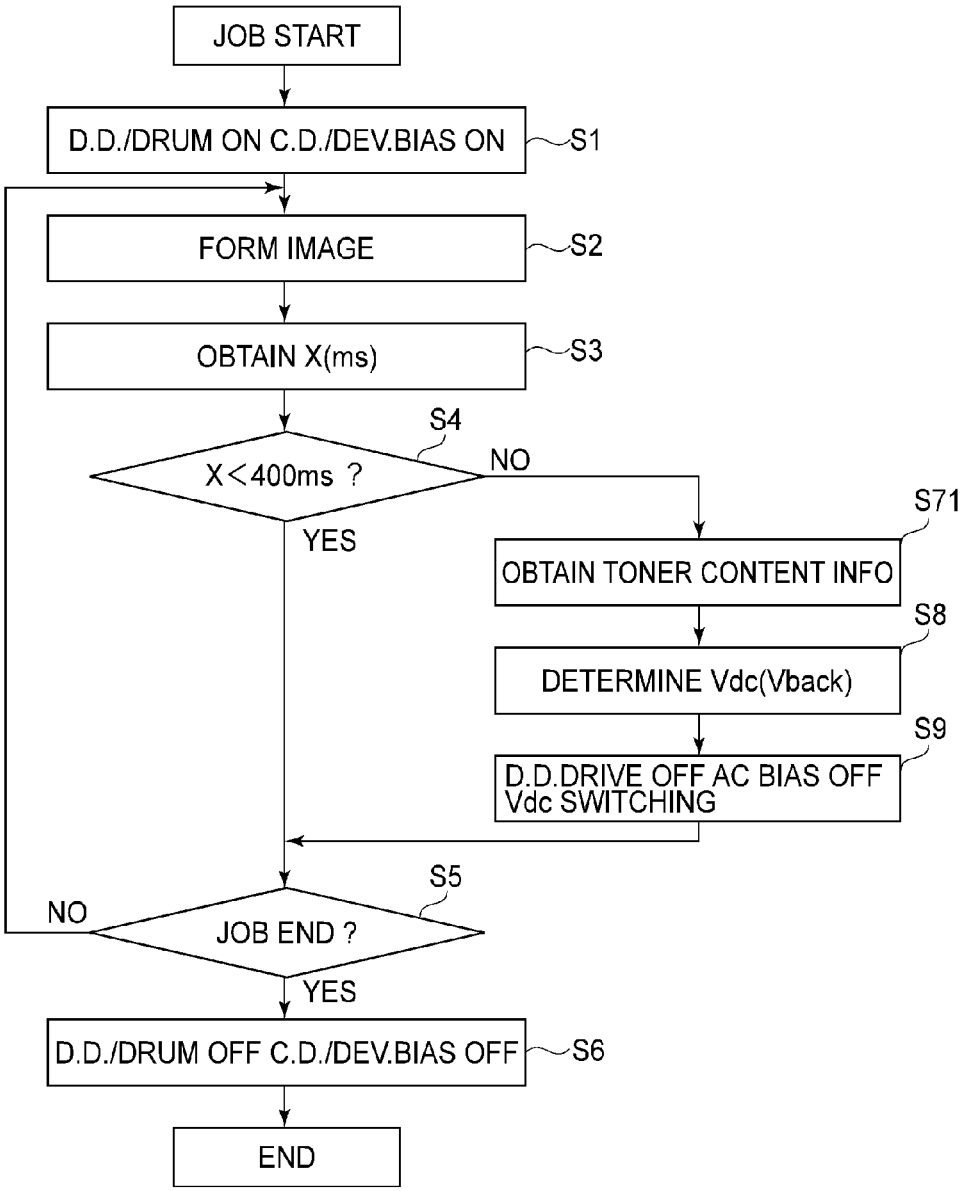

FIG. 13 is a flow chart in Second Embodiment.

Figure 14:
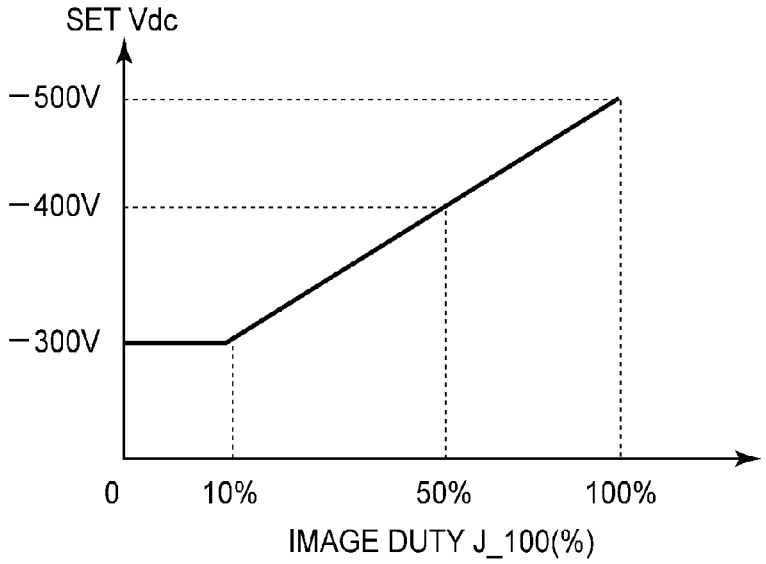

FIG. 14 is a graph showing a setting table of a developing bias in Third Embodiment of the present invention.

Figure 15:
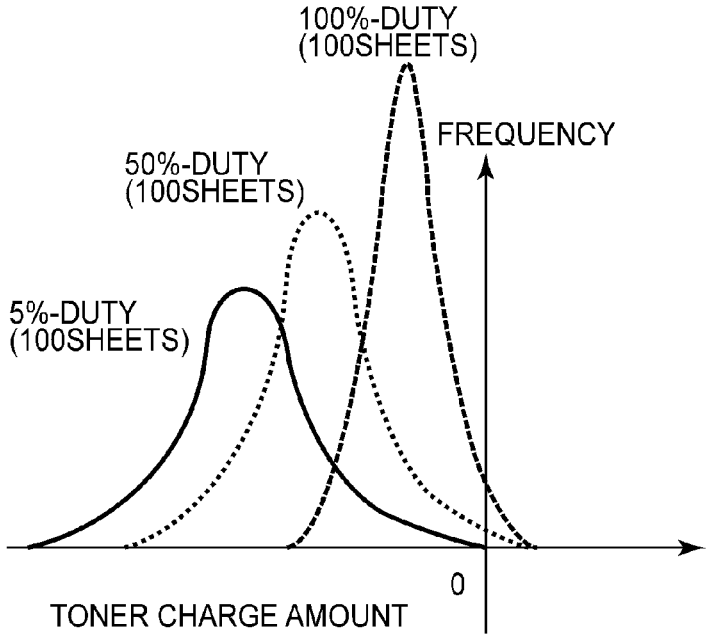

FIG. 15 is a graph showing a relationship between a toner charge amount distribution and an image duty.

Figure 16:
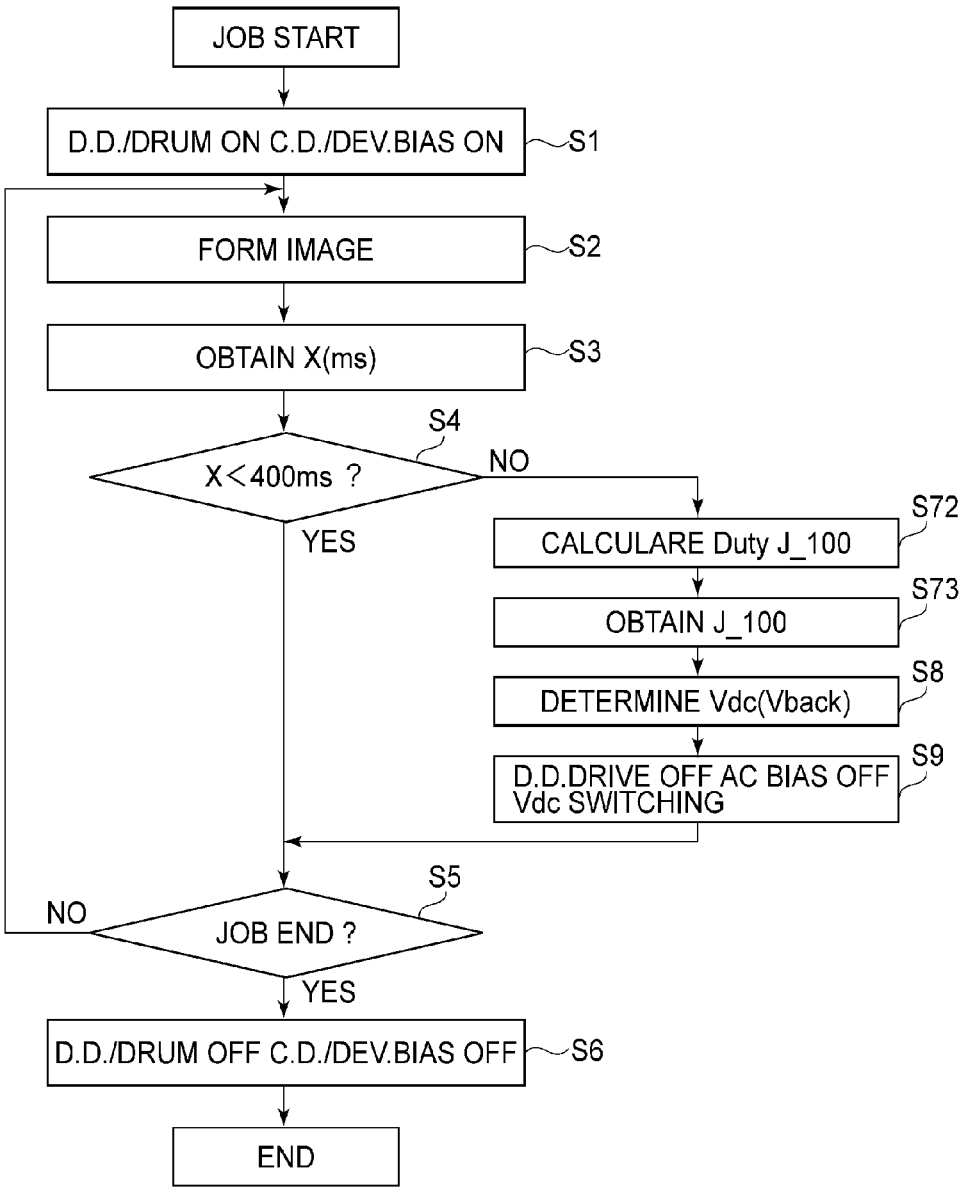

FIG. 16 is a flow chart in Third Embodiment.

Figure 17:
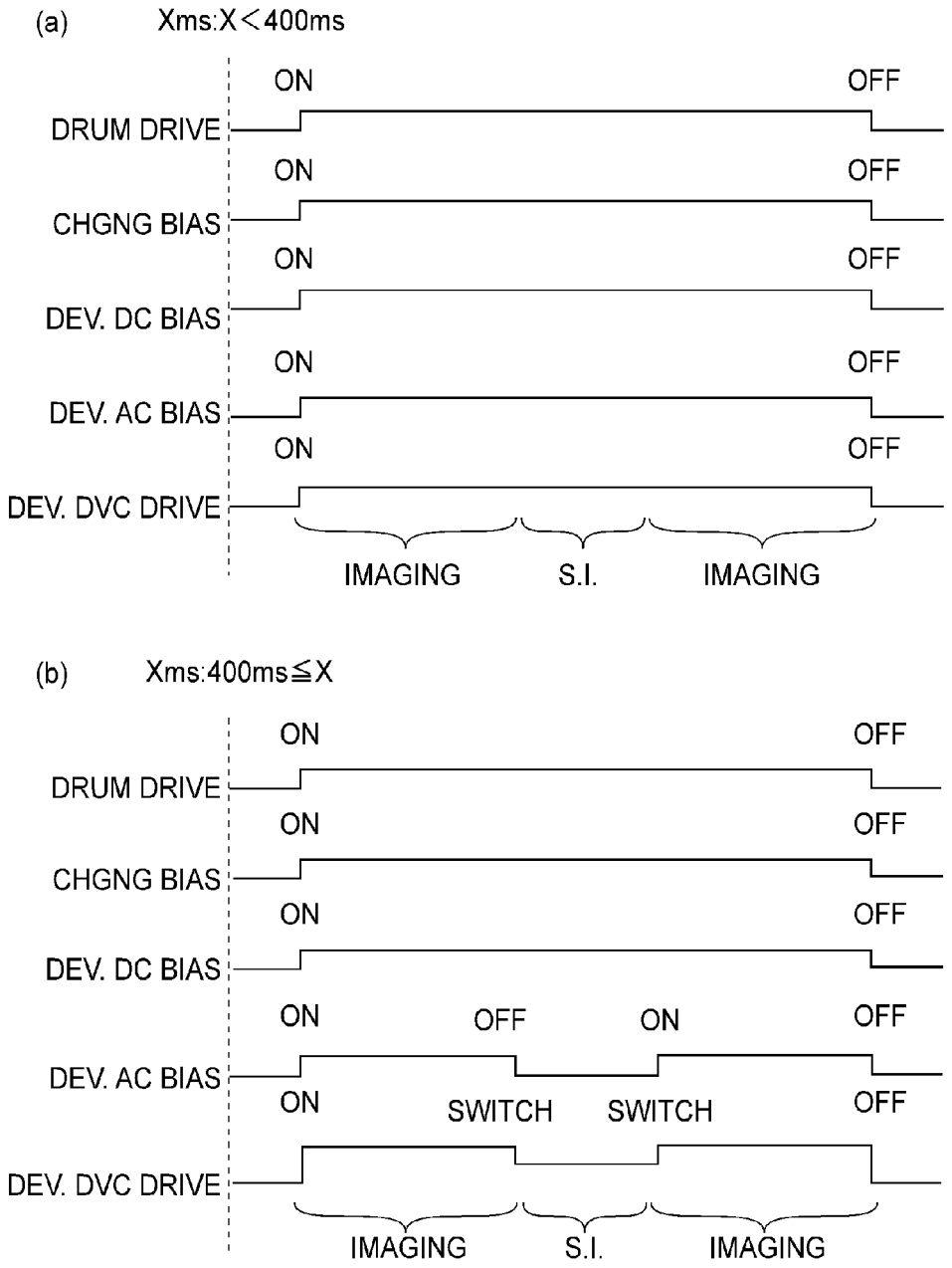

Parts (a) and (b) of FIG. 17 are time charts each showing operations of drive of a photosensitive drum, a charging bias, a developing DC bias, a developing AC bias and drive of a developing sleeve and a developer stirring and feeding screw, wherein (a) shows the case where a sheet interval time is less than a predetermined time, and (b) shows the case where the sheet interval time is not less than the predetermined time in Fourth Embodiment of the present invention.

Figure 18:
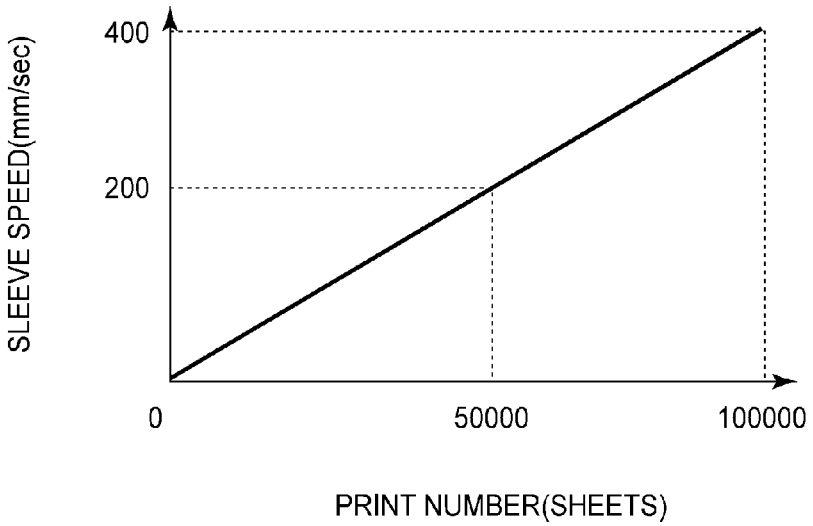

FIG. 18 is a graph showing a setting table of a driving speed of a developing sleeve in Fourth Embodiment.

Figure 19:
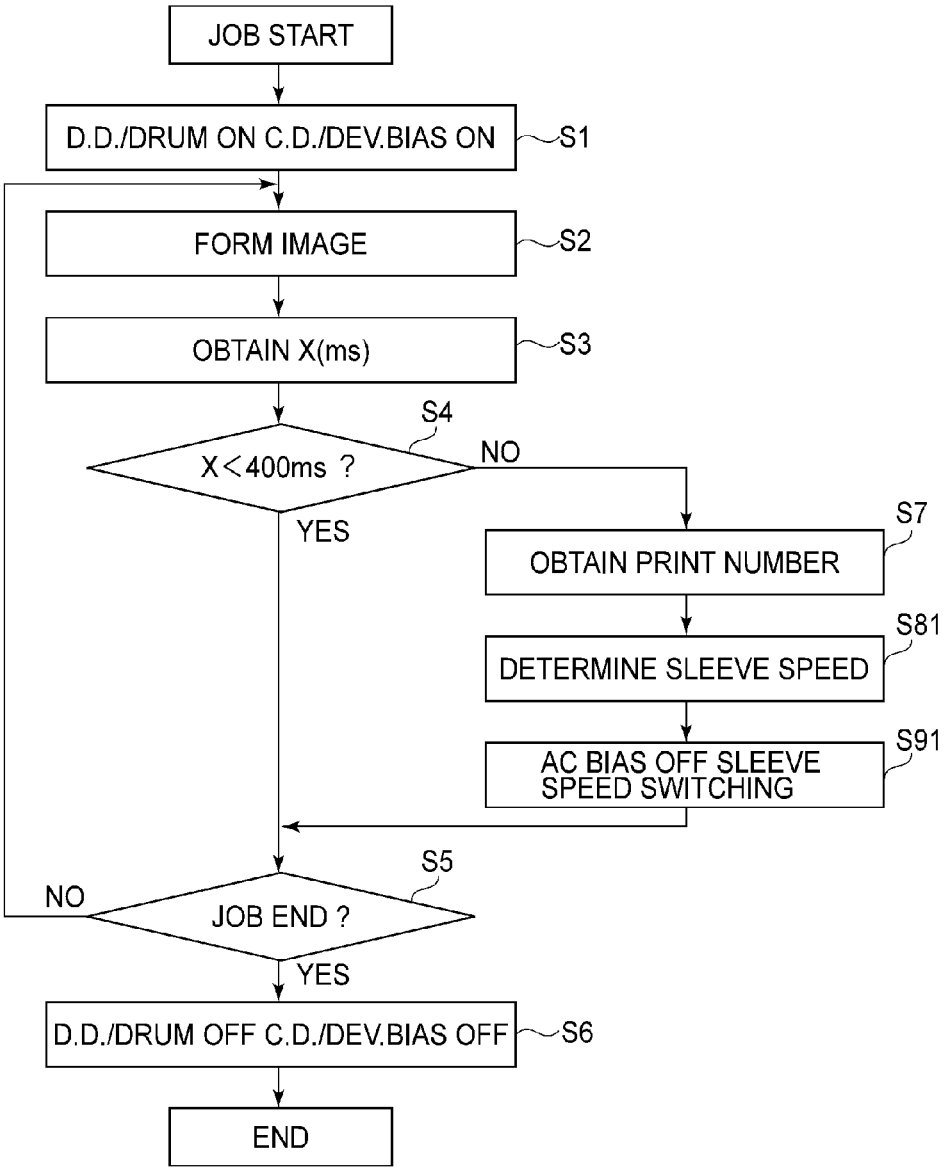

FIG. 19 is a flow chart in Fourth Embodiment.

Figure 20:
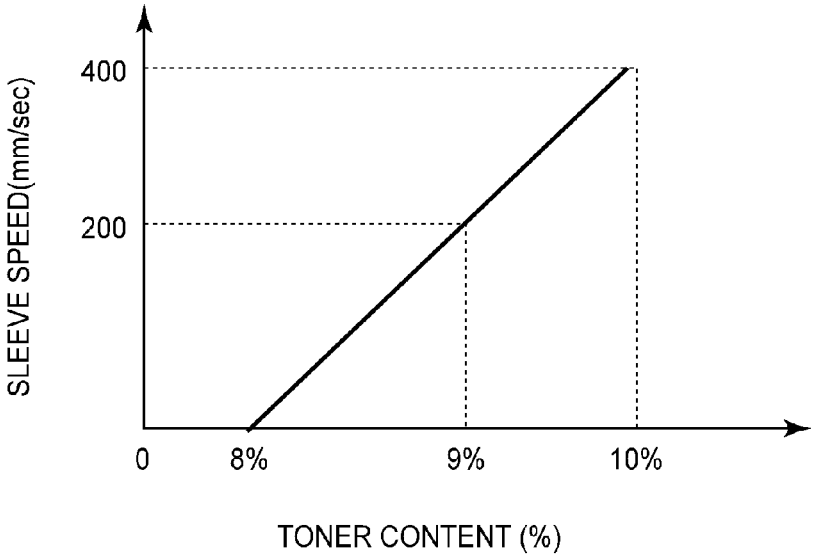

FIG. 20 is a graph showing a setting table of a driving speed of a developing sleeve in Fifth Embodiment of the present invention.

Figure 21:
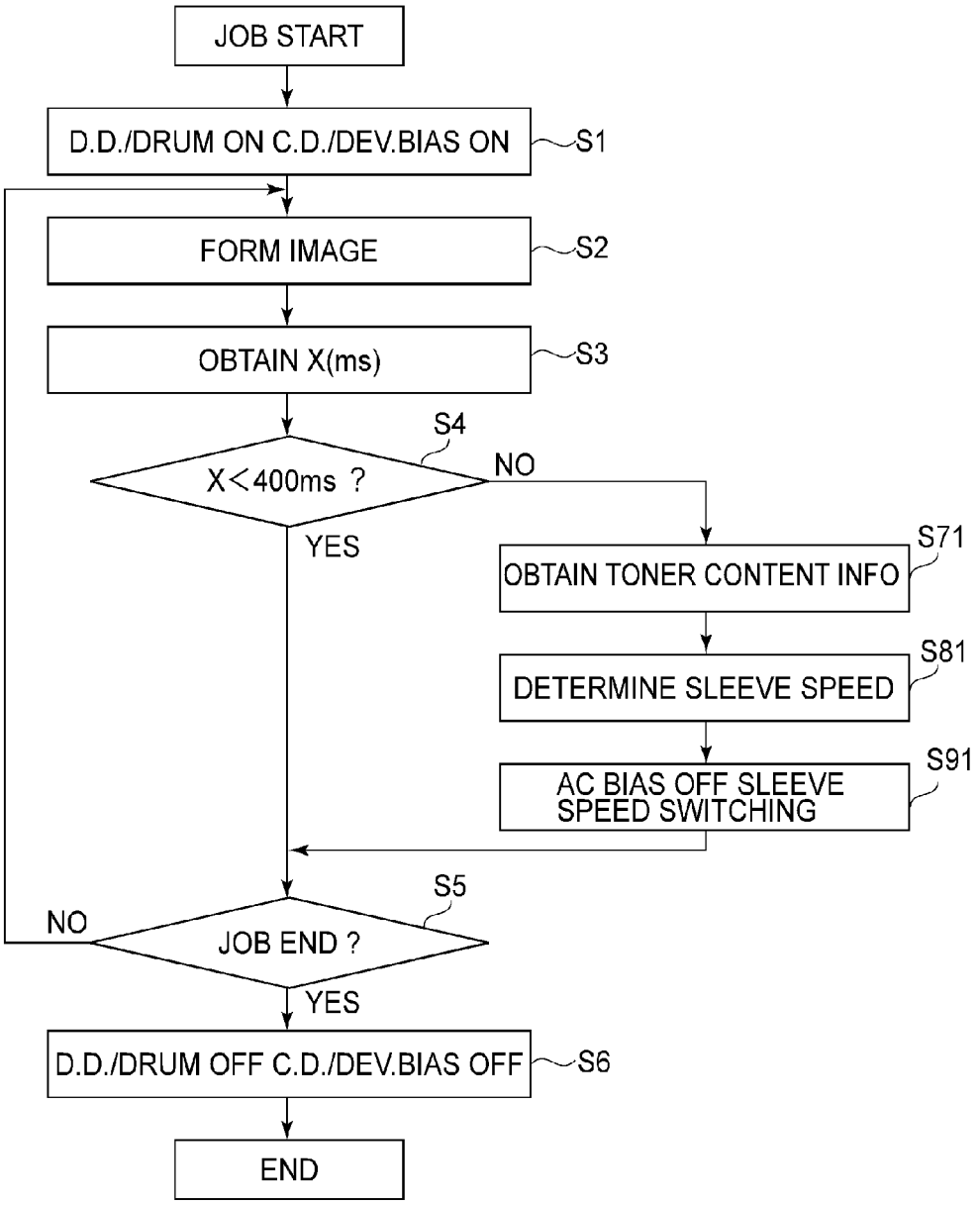

FIG. 21 is a flow chart in Fifth Embodiment.

Figure 22:
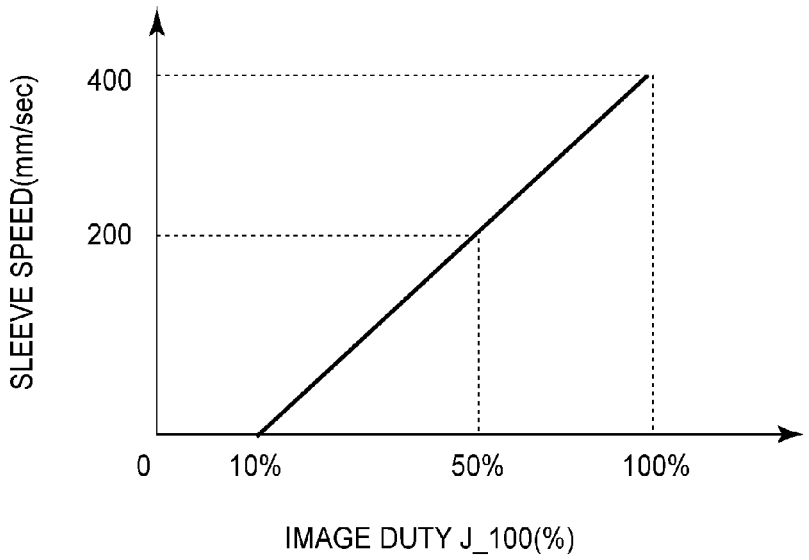

FIG. 22 is a graph showing a setting table of a driving speed of a developing sleeve in Sixth Embodiment of the present invention.

Figure 23:
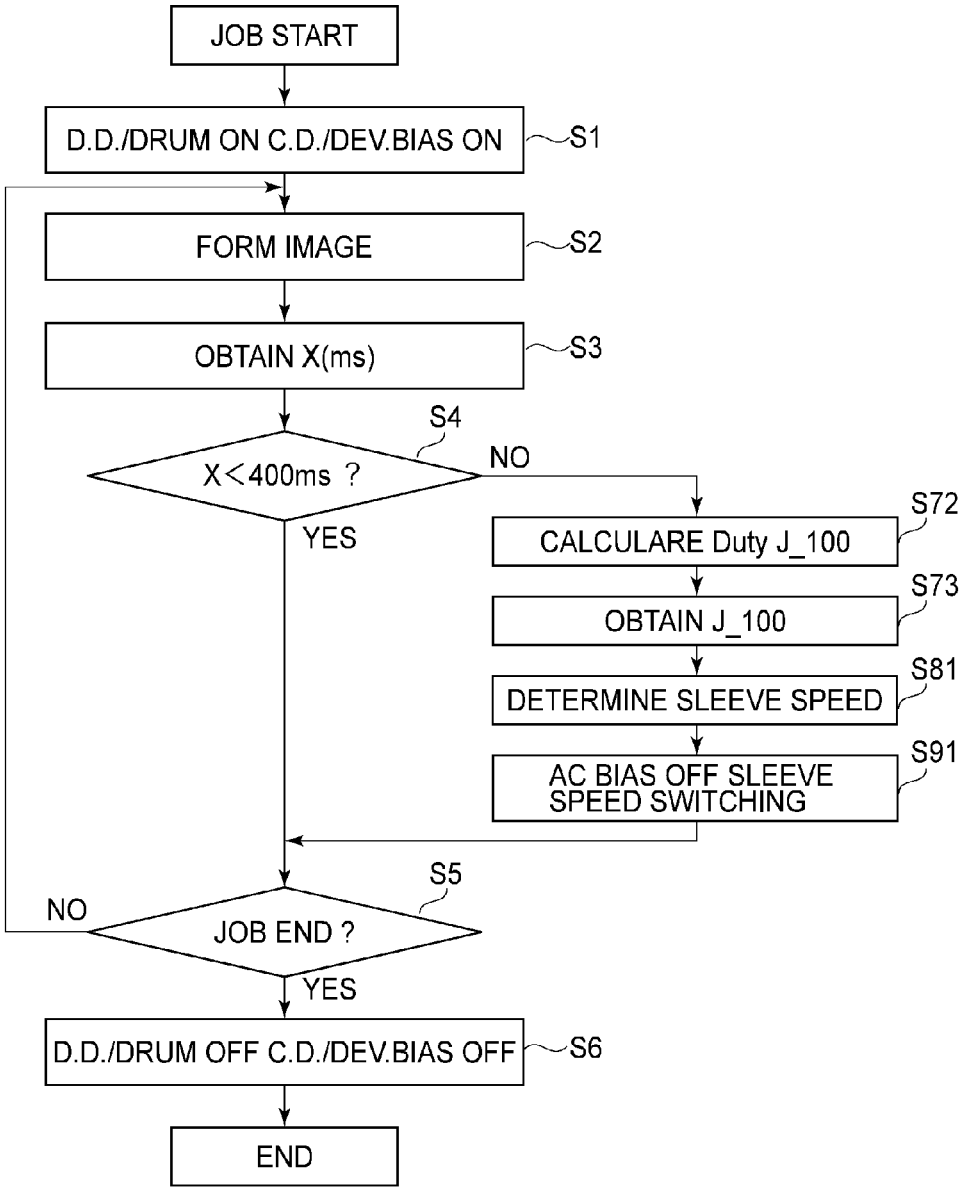

FIG. 23 is a flow chart in Sixth Embodiment.

Figure 24:
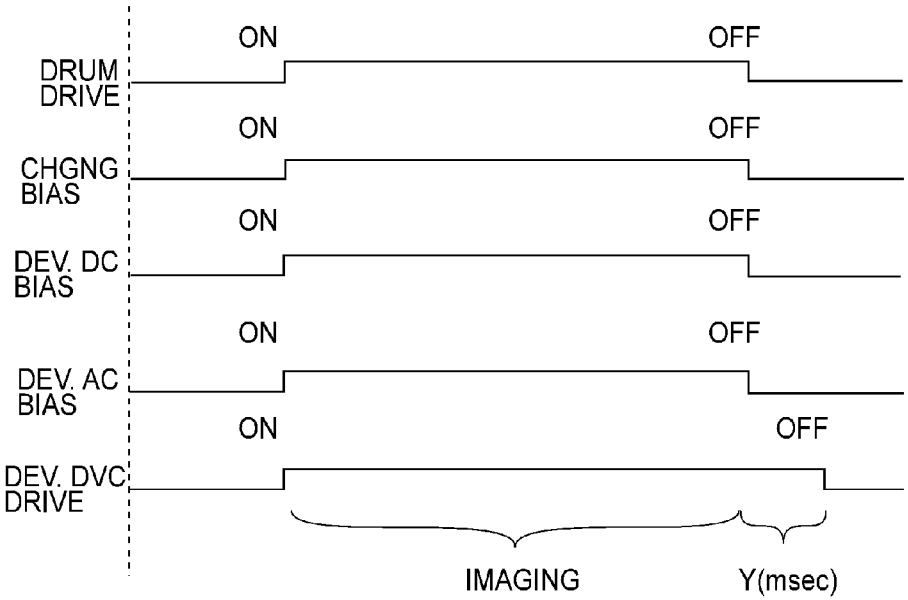

FIG. 24 is a time chart showing operations of drive of a photosensitive drum, a charging bias, a developing DC bias, a developing AC bias and drive of a developing sleeve and a developer stirring and feeding screw in Seventh Embodiment of the present invention.

Figure 25:
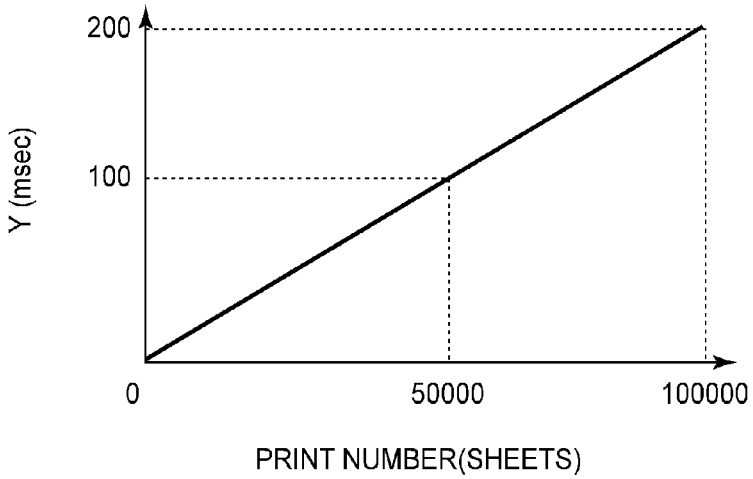

FIG. 25 is a graph showing a setting table of a driving speed of a developing sleeve in Seventh Embodiment.

Figure 26:
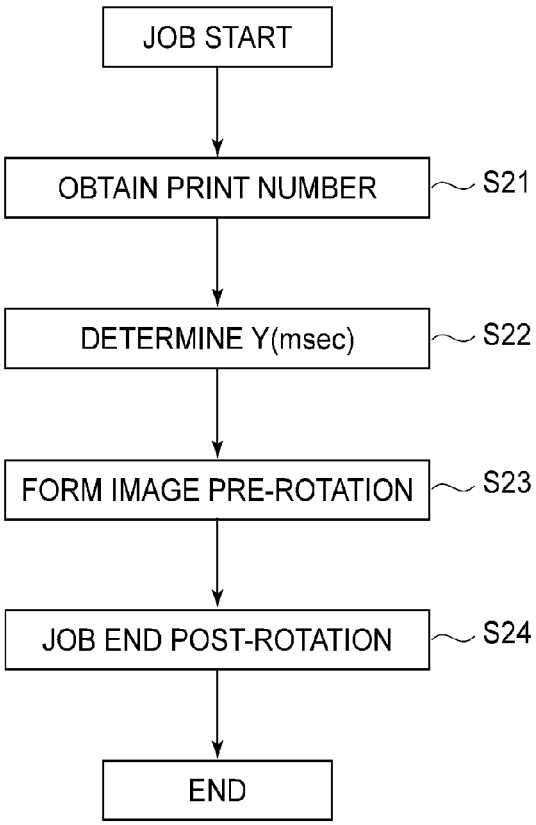

FIG. 26 is a flow chart in Seventh Embodiment.

Figure 27:
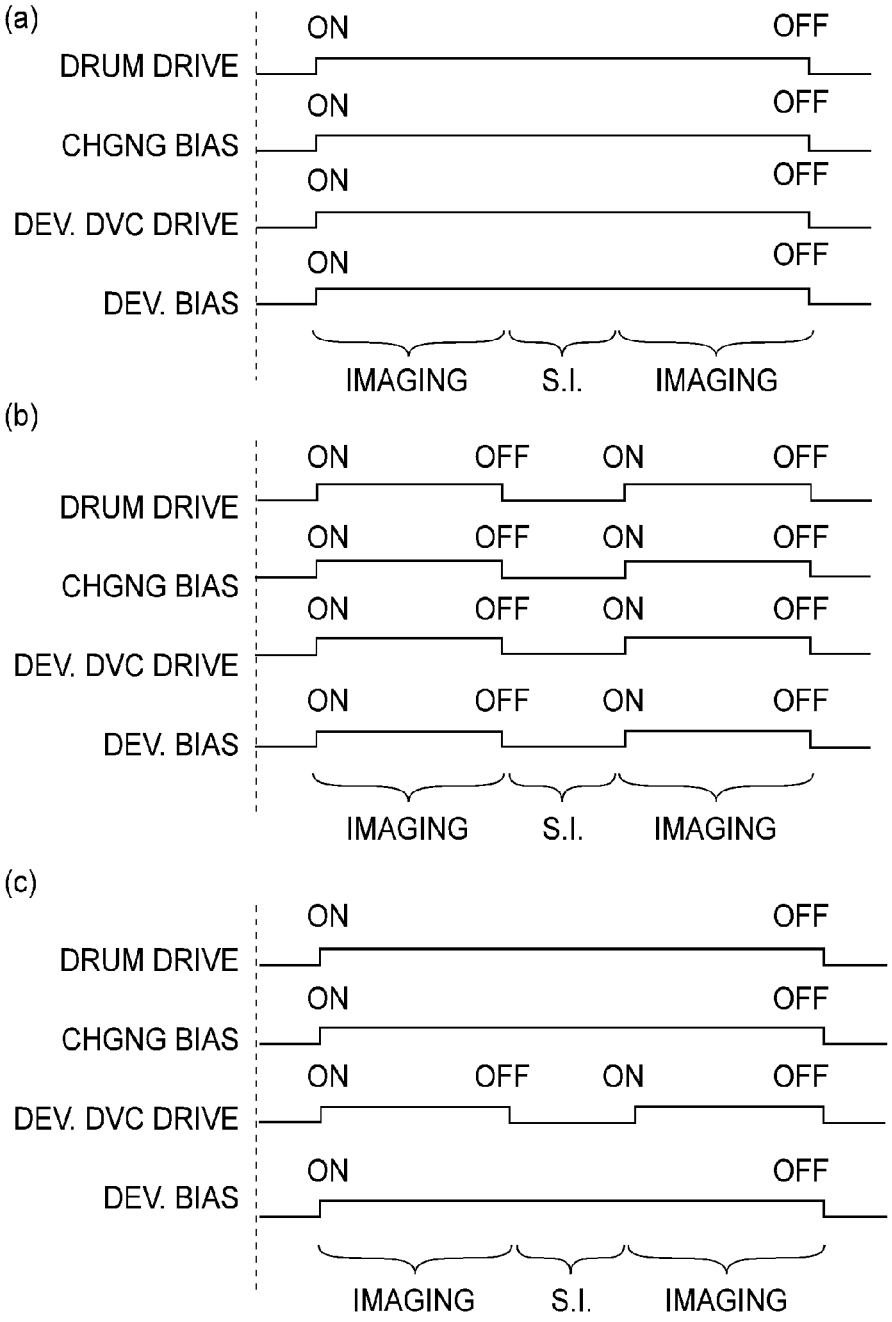

Parts (a), (b) and (c) of FIG. 27 are time charts each showing operations of drive of a photosensitive drum, a charging bias, drive of a developing sleeve and a developer stirring and feeding screw and a developing bias for illustrating a prior art and a problem of the present invention, wherein (a) shows the case where the operations of the respective portions are not changed even in the sheet interval, (b) shows the case where the operations of the respective portions are stopped in the sheet interval, and (c) show the case where only the operation of the drive of the developing sleeve and the developer stirring and feeding screw is stopped.

DETAILED DESCRIPTION OF THE DRAWINGS

First Embodiment

First Embodiment of the present invention will be described with reference to FIGS. 1 to 8. First, an image forming apparatus in this embodiment will be described with reference to FIG. 1.

[Image Forming Apparatus]

An image forming apparatus 100 is an electrophotographic full-color printer including four image forming portions (stations) 1Y, 1M, 1C, and 1Bk provided correspondingly to four colors of yellow (Y), magenta (M), cyan (C) and black (Bk). The image forming apparatus 100 effects image formation depending on an image information signal from an original reading device (not shown) connected to an image forming apparatus main assembly or from a host device (not shown) such as a personal computer communicably connected to the image forming apparatus main assembly. That is, the image forming apparatus 100 can form a four color-based full-color image on a recording material (a recording sheet, a plastic film, fabric, etc.) depending on the image information signal.

The image forming apparatus 100 in this embodiment is of an intermediary transfer type. That is, toner images formed, at the first to fourth image forming portions 1Y, 1M, 1C and 1Bk, electrophotographic photosensitive member (photosensitive drums) (2Y, 2M, 2C and 2Bk) as an image bearing member are transferred onto an intermediary transfer member (intermediary transfer bias) 16. Then, the toner image carried on the intermediary transfer belt 16 is transferred onto a recording material P conveyed along a conveying path 8. This will be described below more specifically.

Incidentally, the four image forming portions 1Y, 1M, 1C and 1Bk have the substantially same constitution except that development colors are different from each other. Therefore, in the following, in the case where there is no need to particularly discriminate the constituent elements, they are collectively described by omitting the suffixes, Y, M, C and Bk added for representing the constituent elements belonging any of the image forming portions. At the image forming portion 1, a cylindrical photosensitive member as the image bearing member, i.e., the photosensitive drum 2 is provided. The photosensitive drum 2 is rotationally driven in an arrow direction in FIG. 1. Around the photosensitive drum 2, a charging roller 3 as a charging means, a developing device 4 as a developing means, a primary transfer roller 5 and a secondary transfer roller 15 which are used as transferring means, a secondary transfer opposite roller 10, and a cleaning device 6 as a cleaning means are disposed.

Figure 1:
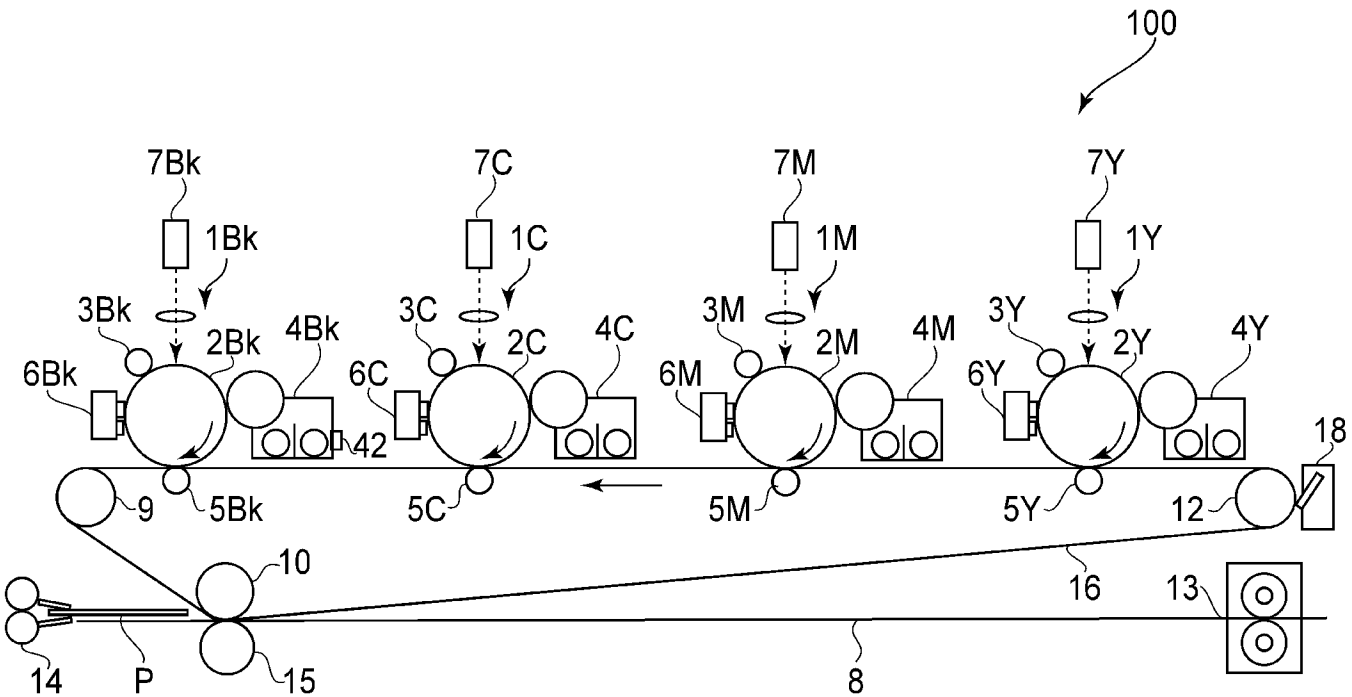
FIG. 1 is a schematic view of an image forming apparatus according to First Embodiment of the present invention.

Above the photosensitive drum 2 in FIG. 1, a laser scanner 7 (expose device) as an electrostatic latent image forming means is disposed. Further, the intermediary transfer belt 16 is disposed oppositely to the photosensitive drum 2 of each of the image forming portions 1. The intermediary transfer belt 8 is circularly moved in the direction indicated by an arrow in FIG. 1 to convey the toner images to a contact portion with the recording material P. Then, after the toner images are transferred from the intermediary transfer belt 16 onto the recording material P, the toner images are heat-fixed on the recording material P by a fixing device 13.

For example, the formation of the four-color based full-color image will be described. First, when the image forming operation is started, the surface of the rotating photosensitive drum 2 is uniformly charged by the charging roller 3. In this case, a charging bias is applied to the charging roller 3 from a charging bias power (voltage) source. Then, the photosensitive drum 2 is exposed to laser light, corresponding to an image information signal, emitted from an exposure device 7. As a result, the electrostatic latent image (electrostatic image) depending on the image information signal is formed on the photosensitive drum 2. The electrostatic latent image formed on each photosensitive drum 2 is developed with the toner stored in the developing device 4, thus being visualized as a visible image. In this embodiment, a reverse developing method in which the toner is deposited at a light potential portion exposed to the laser light is used.

The toner image is formed on the photosensitive drum 2 by the developing device 4 and then is primary-transferred onto the intermediary transfer belt 16. The toner (transfer residual toner) remaining on the surface of the photosensitive drum 2 after the primary transfer is removed by the cleaning device 6.

This operation is successively performed for yellow, cyan, magenta and black, so that the four color toner images are superposed on the intermediary transfer belt 16. Thereafter, the recording material P accommodated in a recording material accommodating cassette (not shown) is conveyed by a supplying roller 14 along the conveying path 8 in synchronism with toner image formation timing. The four color toner images on the intermediary transfer belt 16 are then collectively secondary-transferred onto the recording material P by applying a secondary transfer bias to the secondary transfer roller 15, Then, the recording material P is conveyed to the fixing device 13 as a fixing means. By the fixing device 13, the toner on the recording medium P is subjected to heat and pressure to be melted and mixed, so that a full-color image is formed. Thereafter, the recording material P is discharged to the outside of the image forming apparatus 100.

Further, the toner which is not completely transferred onto the recording material P at a secondary transfer portion and remains on the intermediary transfer belt 16 is removed by an intermediary transfer belt cleaner 18. As a result, a series of the operations is ended. Incidentally, by using only a desired image forming portion, it is also possible to form an image of a desired single color or a plurality of colors.

[Developing Device]

Figure 2:
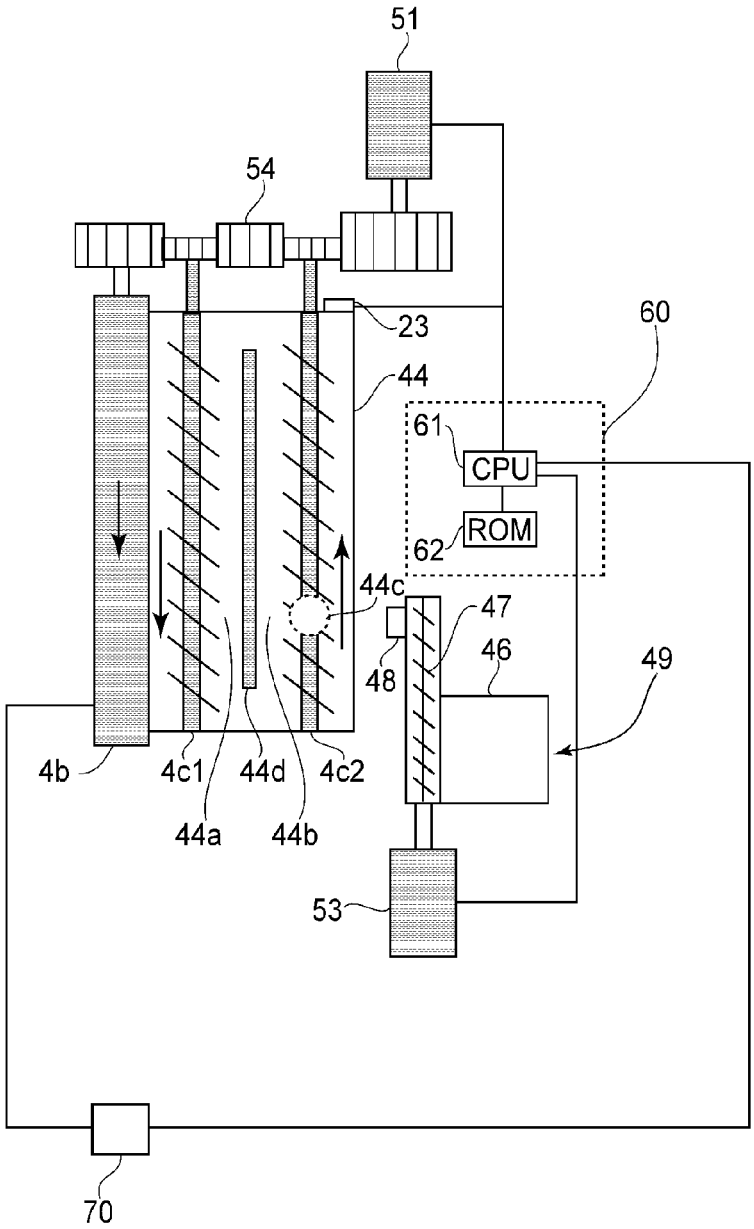
FIG. 2 is a schematic view of a developing device and a toner supplying device in First Embodiment.

Next, the developing device 4 and a toner supplying device 49 for supplying the toner thereto will be described. In this embodiment, all the developing device for yellow, magenta, cyan and black have the same constitution. In FIG. 2, the developing device 4 is illustrated in the form of a plan view as seen from above in FIG. 1, and the toner supplying device 49 is illustrated in the form of a sectional view along an axial direction (perpendicular to a surface movement direction) of the photosensitive drum 2.

The developing device 4 includes a developing container 44 (a main body of the developing device) in which the developer (so-called a two-component developer) primarily including of nonmagnetic toner particles (toner) and magnetic carrier particles (carrier) is accommodated.

The toner includes colored resinous particles containing a binder resin, a coloring agent, and additives which are added as necessary and includes colored particles to which an external additive such as fine powder of colloidal silica has been added. The toner is formed of negatively chargeable polyester resin produced by polymerization and may preferably have a volume average particle size of not less than 5 μm and not more than 8 μm. In this embodiment, the volume average particle size of the toner was 6.2 μm.

As the carrier, magnetic particles of surface-oxidized or unoxidized metals, such as iron, nickel, cobalt, manganese, chrome, and rare-earth metals; alloys of these metals; ferrite, etc., are preferably usable. A method for manufacturing these magnetic particles is not particularly limited. The weight average particle size of the carrier is 20-50 μm, preferably 30-40 μm, and the resistivity of the carrier is not less than $10^7$ ohm·cm, preferably not less than $10^8$ ohm·cm. In this embodiment, the carrier having the resistivity of $10^8$ ohm·cm was used. In this embodiment, as the magnetic carrier which is low in specific gravity, a resinous magnetic carrier, which is manufactured by mixing a phenolic binder resin, a magnetic metal oxide, and a nonmagnetic metal oxide in a predetermined ratio and by subjecting the mixture to the polymerization. The carrier used in this embodiment is 35 μm in volume average particle size, 3.6-3.7 g/cm$^3$ in true density, and 53 A·m$^2$/kg in the amount of magnetization.

In the developing container 44, two screws as stirring and feeding members, consisting of a first stirring and feeding screw **4*c*1 and a second stirring and feeding screw 4*c*2 are disposed. Further, at a position in which the developing container 44 opposes the photosensitive drum 2, a developing sleeve 4*b* as a developer carrying member for carrying and conveying the developer in the developing container 44 is rotatably disposed. Inside the developing sleeve 4*b*, a magnetic roller (unshown) as a magnetic field generating means is fixedly disposed. The magnetic roller has a plurality of magnetic poles with respect to its circumferential direction, and its magnetic force attracts the developer in the developing container 44, not only causing the developer to be carried on the developing sleeve 4*b* but also causing the developer to form an erected chain of the developer (magnetic brush) at a developing position in which it opposes the photosensitive drum 2**.

The developing sleeve **4*b* and the first and second stirring and feeding screws 4*c*1 and 4*c*2 are disposed in parallel. The inside of the developing container 44 is divided into a first chamber 44*a* (developing chamber) and a second chamber 44*b* (stirring chamber) by a partition wall 44*d*. The developing chamber 44*a* and the stirring chamber 44*b* are connected to each other at both longitudinal end portions of the developing container 44. The developing sleeve 4*b* and the stirring and feeding screws 4*c* are rotationally driven by a motor 51 as a driving means. The first stirring and feeding screw 4*c*1 is disposed in the developing chamber 44*a*, and the second stirring and feeding screw 4*c*2 is disposed in the stirring chamber 44*b*. These first and second stirring and feeding screws 4*c*1 and 4*c*2 are rotationally driven in the same direction by rotation of the motor 51 through a gear train 54**.

By the rotation of the motor 51, the developer in the stirring chamber **44*b* is moved upward in FIG. 2 by the second stirring and feeding screw 4*c*2 while being stirred by the screw 4*c*2, and then, moves into the developing chamber 44*a* through the connecting portion. Further, the developer in the developing chamber 44*a* is moved downward in FIG. 2 by the first stirring and feeding screw 4*c*1 while being stirred by the screw 4*c*1, and moves into the stirring chamber 44*b*** through the connecting portion. By the stirring and feeding as described above, the toner in the developer is provided with electric charges.

The developing sleeve **4*b* conveys the developer coated on its surface in a layer by a regulating blade (unshown) to the developing position in which the layer of developer opposes the photosensitive drum 2, by its rotation. At the developing position, the developer on the developing sleeve 4*b* is caused to form the erected thereof by the magnetic force of the magnetic roller, thus forming the magnetic brush which is in contact with or in proximity to the surface of the photosensitive drum 2. Thus, the toner is supplied to the electrostatic latent image on the photosensitive drum 2** from the (two-component) developer which has been conveyed to the developing position. As a result, the toner is selectively deposited on the image portion for the electrostatic latent image, so that the electrostatic latent image is developed as the toner image.

Further, when the electrostatic latent image on the photosensitive drum 2 reaches the developing position, a developing bias in the form of superposition of AC and DC voltages is applied to the developing sleeve 4*b* from a development bias application power source 70. At this time, the developing sleeve 4*b* is rotationally driven and by the above-described developing bias, the toner in the developer is transferred onto the photosensitive drum 2 depending on the electrostatic latent image on the surface of the photosensitive drum 2.

Figure 3:
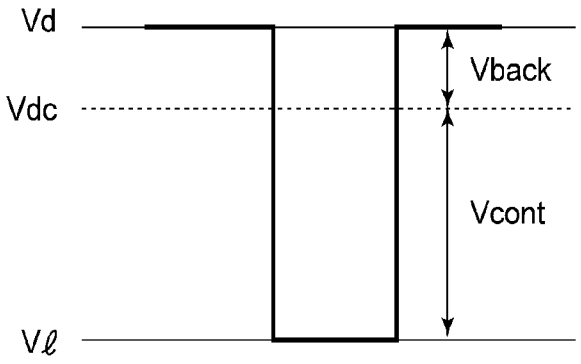
FIG. 3 is a schematic view for illustrating potential setting in First Embodiment.

FIG. 3 shows a relationship among potentials at the image portion and the non-image portion on the photosensitive drum 2 and the developing bias applied to the developing sleeve 4*b*. In this embodiment, as described above, at the exposed portion on the negatively charged photosensitive drum 2, the electrostatic latent image is developed with the negative toner to be visualized as the toner image. In FIG. 3, each of an image portion potential (Vl) and a non-image portion potential (white background portion potential) (Vd), and an absolute value (Vdc) of the DC component of the developing bias applied to the developing sleeve 4*b* is schematically illustrated.

[Toner Supply]

In this embodiment, as shown in FIG. 2, the toner is supplied from a toner supply opening 44*c* provided at an upper portion at an upstream and portion side in the stirring chamber 44*b* with respect to a developer conveyance direction. At a downstream side of the stirring chamber in FIG. 2, a window portion for permitting eye observation of an inside state therethrough from the outside of the stirring chamber 44*b*.

By the above-described developing operation, the toner in the two-component developer is consumed, so that a toner content (concentration) of the developer in the developing container 44 is gradually decreased. Therefore, the toner is supplied to the developing container 44 by the toner supplying device 49. The toner supplying device 49 includes a toner container (toner supplying container or toner storage portion) 46 for accommodating the toner to be supplied to the developing device 4.

At an upper left end portion of the toner container 46 in FIG. 2, a toner discharge opening 48 is provided. The toner discharge opening 48 is connected to the toner supply opening 44*c* of the developing device 4. In the toner container 46, a toner supplying screw 47 as a toner supplying means for feeding the toner toward the toner discharge opening 48 is provided. The toner supplying screw 47 is rotationally driven by a motor 53.

The rotation of the motors 51 and 53 is controlled by a CPU (control means) 61 of an engine controller 60 provided in the image forming apparatus main assembly. A relationship between a rotation time of the motor 53 in a state in which the toner in a predetermined amount is accommodated in the toner container 46 and an amount of the toner to be supplied into the developing container by a toner supplying screw 4*h* has been obtained through an experiment or the like. The result thereof has been, e.g., stored as table data in an ROM 62 connected to the CPU 61 (or in the CPU 61). That is, the CPU 61 controls (adjusts) the rotation time of the motor 53, so that the amount of the toner to be supplied to the developing container.

Incidentally, the CPU 61 also controls the developing bias application power source 70. That is, the CPU 61 changes the developing bias to control the potential difference between the surface potential of the photosensitive drum 2 and the developing bias. Further, the developing device 4 is provided with a storing device 23. As the storing device 23, in this embodiment, readable and writable RP-ROM is used. The storing device 23 is electrically connected to the CPU 61 by setting the developing device 4 into the image forming apparatus main assembly, so that image forming process information for the developing device 4 can be read and write from a printer side. Incidentally, an exchange lifetime of the developing device 4 in this embodiment, e.g., 100,000 sheets as a print number (number of sheets subjected to image formation).

[Operation Process of Image Forming Apparatus]

Figure 4:
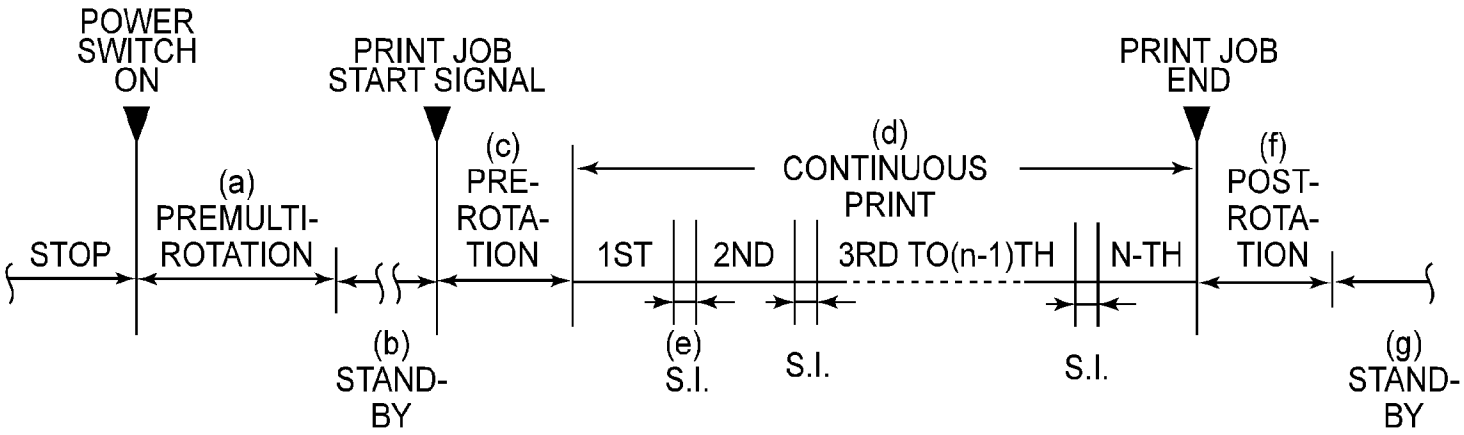
FIG. 4 is a time chart for illustrating operation steps of the image forming apparatus of First Embodiment.

An operation process of the image forming apparatus in this embodiment will be described with reference to FIG. 4.

(a) Pre-Multirotation Step

This step is performed in a predetermined start (actuation) operation period (warming period) of the image forming apparatus. In this step, a main power switch of the image forming apparatus is turned on to actuate a main motor of the image forming apparatus, so that a preparatory operation of necessary process equipment is performed.

(b) Stand-By

After the predetermined start operation period is ended, the drive of the main motor is stopped and the image forming apparatus is kept in a stand-by state until a print job start signal is inputted.

(c) Pre-Rotation Step

In a period for a pre-rotation step, the main motor is driven again on the basis of the input of the print job start signal to perform a print job pre-operation of necessary process equipment.

More specifically, (1) the image forming apparatus receives the print job start signal, (2) an image is decompressed by a formatter (a decompression time varies depending on an amount of image data or a processing speed of the formatter, and then (3) the pre-rotation step is started. Incidentally, in the case where the print job start signal is input during the pre-multirotation step (a), after the pre-multirotation step (a) is completed, the operation goes to this pre-rotation step (c) with no stand-by (b).

(d) Print Job Execution

When the predetermined pre-rotation step is completed, the above described image forming process is executed, so that a recording material P on which the image has been formed is output. In the case of a successive print job, the image forming process is repeated, so that a predetermined number of image-formed sheets of the recording material P are output.

(e) Sheet Interval Step

This step is a step of an interval between a trailing end of a certain recording material P and a leading end of a subsequent recording material P in the case of the successive print job, and is a non-sheet passing state period at the transfer portion or in the fixing device. In other words, the sheet interval step is a step of a conveyance interval between a recording material subjected to the image formation and a recording material conveyed subsequently to the recording material.

(f) Post-Rotation Step

The main motor is continuously driven for a predetermined time after the image-formed recording material P is outputted in the case of the print job for one sheet of the recording material P or after a final image-formed recording material P is outputted in the case of the successive print job. As a result, the print job post-operation of necessary process equipment is executed in this period.

(g) Stand-By

After the predetermined post-rotation step is completed, the drive of the main motor is stopped and the image forming apparatus is kept in a stand-by state until a subsequent print job start signal is inputted.

In the above, the time of the print job execution (d) is the time of the image formation, and the time of the pre-multirotation step (a), the time of the pre-rotation step (c), the time of the sheet interval step (e) and the time of the post-rotation step (f) are the time of a non-developing operation. Incidentally, the time of the print job execution (d) from which the time of the sheet interval step (e) is excluded is the time of the developing operation.

The time of the non-developing operation is at least one of the above-described times, when the development by the developing device 4 is not effected, of the pre-multi rotation step, the pre-rotation step, the sheet interval step and the post-rotation step, or is at least a predetermined time period in each of the times of the above steps.

At the time of the non-developing operation, at least during the rotation of the photosensitive drum 2 and the developing sleeve 4*b*, a predetermined voltage is applied to the charging roller 3 and the developing sleeve 4*b*. As a result, a predetermined potential difference (fog-removing potential) is provided between the photosensitive drum 2 and the developing sleeve 4*b*. This is because occurrences of the toner fog and the carrier deposition are suppressed by the rotation of the photosensitive drum 2 and the developing sleeve 4*b* during the non-developing operation, and the fog-removing potential similar to that during normal image formation is set. Specifically, by setting the surface potential (Vd potential) of the develop 2 at −500 V and the developing bias voltage (Vdc) at −300 V, the fog-removing potential (Vback) of 200 V is provided. Further, an image forming speed (the rotational speed of the photosensitive drum 2 and the conveyance speed of the recording material, hereinafter referred to as a process speed) in this embodiment is 300 mm/sec, and the rotational speed of the developing sleeve 4*b* is 400 mm/sec.

Figure 5:
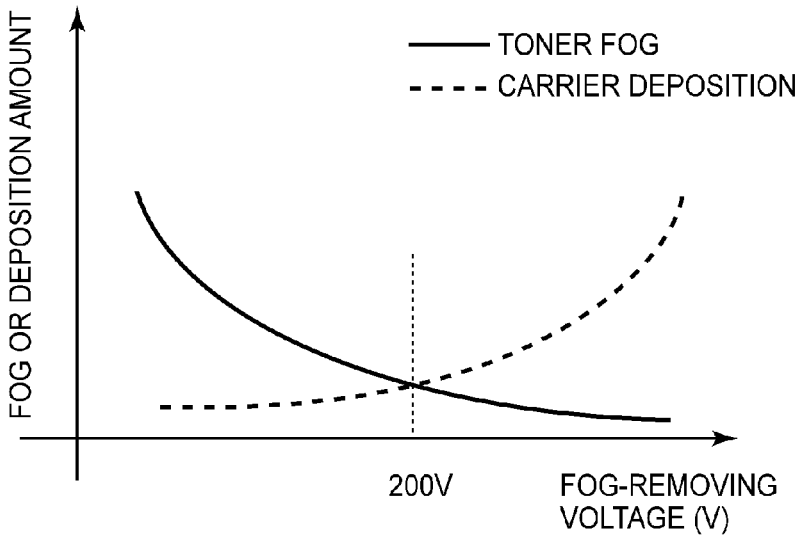
FIG. 5 is a graph showing a relationship between a fog-removing potential and a toner fog amount and between the fog-removing potential and a carrier deposition amount.

Next, a relationship bias the fog-removing potential and the toner fog or the carrier deposition occurring on the photosensitive drum 2 will be described with reference to FIG. 5. As shown in FIG. 5, a degree of the toner fog is increased with a decrease of the fog-removing potential and on the other hand, the carrier deposition amount is increased with an increase of the fog-removing potential. This is because the charged toner has the negative polarity and therefore is liable to be used for development on the photosensitive drum with the decrease of the fog-remaining potential and on the other hand, the carrier has the positive polarity and therefore is liable to be used for development on the photosensitive drum with the increase of the fog-remaining potential. For that reason, when the fog-removing potential is set at a low level, the image defect resulting from the carrier deposition can be suppressed but the toner fog at the white background portion occurs. In this embodiment, from FIG. 5, in order to suppress both of the toner fog and the carrier deposition, the fog-removing potential is set at 200 V.

In this embodiment, as the case where the time of the sheet interval is more than the time of the normal image formation, there are the case of the inserting paper for which sheets of different paper sizes a different paper types are inserted and the case of a bookbinding operation including insertion of the front cover and the back cover, cutting and use of a stapler. There arises the case where a combined instruction of some of these processes is obtained by the CPU 61 and during its copy job, the time of the sheet interval is increased and the CPU 61 awaits start of subsequent printing in a state in which the printing is not effected. The range of the time of the sheet interval in this embodiment is from 70 msec to 1000 msec.

[Sheet Interval Control]

Next, sheet interval control during the continuous image forming job in this embodiment will be described with reference to FIGS. 6 and 7. Parts (a) and (b) of FIG. 6 are timing charts each in the sheet interval in the continuous image forming (during an image forming period in which the image formation is continuously effected on a plurality of the recording materials) in this embodiment, and FIG. 7 is a table showing a relationship between the print number (of sheets subjected to the image formation) and the developing DC bias Vdc for setting the fog-removing potential Vback in the sheet interval.

Incidentally, in FIG. 6, "ON" and "OFF" of the drive of the photosensitive drum 2 are the rotational drive of the photosensitive drum 2 and stop of the rotational drive of the photosensitive drum 2, respectively. Further, "ON" and "OFF" of the charging bias are application of the charging bias for charging the surface of the photosensitive drum 2 by the charging roller 3 and stop of the application. "ON" and "OFF" of the drive of the developing device are rotational drive of the developing sleeve 4*b* and the stirring and feeding screws 4*c*1 and 4*c*2 and stop of the rotational drive. The developing AC bias is an AC component of the developing bias applied to the developing sleeve 4*b*, and the developing DC bias is a DC component of the developing bias. Further, "ON" and "OFF" of the developing AC bias are application of the AC component and stop of the application. Further, "SWITCH" of the developing DC bias is, as described later, a change of the applied DC component.

In this embodiment, in the sheet interval (during the non-developing operation) in which the development by the developing device 4 is not effected, in the case where the surface of the photosensitive drum 2 is charged, an operational condition of the developing device 4 is controlled by the CPU 61 as the control means. Here, in this embodiment, as the operational condition of the developing device 4, the fog-removing potential difference which is the potential difference between the surface potential of the photosensitive drum 2 and the developing bias applied to the developing sleeve 4*b* is controlled. However, in the case where a sheet interval time X (ms) is less than a predetermined time (e.g., 400 ms), as shown in (a) of FIG. 6, the operation during the image formation is not changed also in the sheet interval. In the case where the sheet interval time X (ms) is not less than the predetermined time (in the case where the conveyance interval is not less than a predetermined interval), as shown in (b) of FIG. 6, the operation is changed in the sheet interval.

That is, as shown in (a) of FIG. 6, in the case where the sheet interval time is short, similarly as during the image formation even in the sheet interval, each of the photosensitive drum drive, the charging bias, the developing device drive, the developing AC bias and the developing DC bias is kept in the "ON" state.

On the other hand, as shown in (b) of FIG. 6, in the case where the sheet interval time is long, in the sheet interval, the developing device drive and the developing AC bias are once stopped ("OFF"), and the developing DC bias is changed in accordance with the table shown in FIG. 7. That is, an operation in a mode in which the driving speed of the developing sleeve is made lower than that during the developing operation or in which the drive of the developing sleeve is stopped is executed. The table of FIG. 7 is stored in ROM 62 connected to the CPU 61 (or in the CPU 61).

For example, the fog-removing potential difference Vback during the normal image formation is set at 200 V, and the fog-removing potential difference Vback in the sheet interval is changed depending on the print number. The print number is counted by the CPU 61. The print number is information correlating to the toner charge amount of the developer in the developing container 44. Therefore, the CPU 61 also functions as a charging amount information detecting means. This will be described later.

Further, the fog-removing potential difference Vback is, as shown in FIG. 3, the potential difference between the non-image portion potential Vd and the DC component Vdc of the developing bias. The non-image portion potential Vd is the surface state of the photosensitive drum 2 charged by the charging roller 3. Therefore, in order to change the fog-removing potential difference Vback, at least one bias of the charging bias by the charging roller 3 and the DC component of the developing bias may be changed. In this embodiment, the charging bias is not changed but the developing DC bias Vdc is changed by controlling the developing bias application power source 70 by the CPU 61.

Incidentally, in this embodiment, the developing device drive is once stopped in the sheet interval. This is because a developer deterioration and a developing device part deterioration are suppressed by avoiding an idling state of the developing device. Further, the reason why the developing AC bias is once stopped simultaneously with the stop of the developing device drive is that the developing AC bias is turned off to suppress movement (jumping) of the toner from the carrier and to suppress the deposition of the toner on the sleeve surface even in a slight amount.

Next, such a point that the print number is used as the information correlating to the toner charge amount of the developer in the developing container 44 and on the basis of this information, the fog-removing potential difference Vback is controlled will be described. As described above, in a state in which the developing device drive is stopped in the sheet interval, a phenomenon that the toner is deposited on the developing sleeve surface occurs conspicuously in the case where the toner charge amount (absolute value) of the two-component developer is lowered. By the lowering of the toner charge amount, the electrical depositing force of the toner on the carrier is decreased, with the result that the toner is liable to be separated from the carrier by the fog-removing potential difference Vback.

As a status in which the toner charge amount is lowered, there are the case where the number of use of the two-component developer in the developing device is large and the case where the print number is large. That is, the large print number means that the developing device 4 is driven for a long time. Here, when the developing device 4 is driven for a long time, the toner is used for development and fresh toner is successively supplied into the developing container 44, whereas the deterioration of the carrier in the developing container 44 proceeds. For example, a charging performance of the carrier is lowered by spent toner and deposition of an external additive on the carrier. Then, by the lowering of the charging performance of the carrier, the toner charge amount is lowered. Therefore, the toner charge amount tends to be lowered with an increase of the print number.

For this reason, in this embodiment, the print number is counted as the information correlating to the toner charge amount of the developer in the developing container (developing device) and then depending on the print number, the fog-removing potential difference Vback is controlled. That is, with the increase of the print number (with an increase of a degree of the tendency that the toner charge amount is lowered), the fog-removing potential difference Vback is made small. Specifically, the absolute value of Vdc is increased, so that Vback is made small. Thus, the toner is made less tending to be deposited on the developing sleeve 4*b*.

In this embodiment, during the image formation (during the developing operation), the surface potential (Vd potential) of the photosensitive drum 2 is set at −500 V, and the developing bias voltage (Vdc) is set at −300 V. During the sheet interval (during the non-developing operation), when the Vback in the sheet interval is changed, the setting of Vdc is changed in accordance with the table of FIG. 7.

A series of control in this embodiment will be described with reference to FIG. 8. When the image formation (copying job) is started, the drives of the developing sleeve 4*b* of the developing device 4, the screws 4*c*1 and 4*c*2 and the photosensitive drum 2 are started, and the charging bias and the developing bias are also raised (S1). Then, the normal image formation is started (S2). Then, the CPU 61 obtains the sheet interval time X (S3) and when the sheet interval time X is less than 400 ms which is the predetermined time (YES of S4), the state is kept as it is. Then, when the job is ended (YES of S5), the respective drives of the developing device and the like and the biases are turned off (S6). When the job is not ended (NO of S5), the operation is returned to S2.

On the other hand, when the sheet interval time X is not less than 400 ms (NO of S4), the CPU 61 obtains the print number (S7). Then, from the obtained print number, the developing DC bias Vdc (for Vback) applied in the sheet interval is determined in accordance with the table of FIG. 7 (S8). Then, in the sheet interval, the developing device drive is once stopped and at the same time, the developing AC bias is turned off and the developing DC bias is switched to the value determined in S8 and then is applied to the developing sleeve 4*b* (S9).

Thus, in the case where the sheet interval time is increased so as to be not less than the predetermined time (not less than 400 ms in this embodiment), simultaneously with the timing-off of the developing device drive in the sheet interval, the developing AC bias is turned off and the Vback is changed. As a result, even when the print number reached 100,000 sheets which was the exchange lifetime of the developing device, the image defect due to the toner charge amount lowering, such as fog or toner scattering, and defective image, such as a toner stripe, due to the toner deposition on the sleeve surface did not occur. On the other hand, the Vback is set at the same value through the print number corresponding to the lifetime of the developing device, in the latter half of the lifetime, the toner stripe due to setting such that the Vback cannot be set at a sufficiently small value occurred. Further, on the other hand, in the front half of the lifetime, due to setting such that the Vback is set at an excessively small value, excessive toner consumption occurred.

As described above, in the case where the developing device drive is stopped in the sheet interval during the continuous image formation, the Vback in the sheet interval is changed depending on the print number. As a result, irrespective of the status of use of the developer, it is possible to suppress the occurrence of the image defect such as the toner stripe to effect stable image formation for a long term.

Incidentally, in this embodiment, the Vback in the sheet interval is changed in the case where the developing device drive is stopped in the sheet interval during the continuous image formation but the present invention is not limited thereto. For example, also in the case where the developing device driving speed in the sheet interval is made slower than that during the normal image formation, a similar effect can be obtained by the changing the Vback in the sheet interval depending on the print number as in this embodiment. Further, even when the developing device driving speed in the sheet interval is equal to that during the normal image formation, in the case where the image formation on a large print number is continuously effected to considerably lower the toner charge amount, a similar effect can be obtained by changing the Vback in the sheet interval depending on the print number as in this embodiment.

Further, in this embodiment, in the case where the developing device drive is stopped in the sheet interval during the continuous image formation, the developing AC bias is turned off but in this case, the developing AC bias may also be kept in the "ON" state.

Further, in this embodiment, as the information correlating to the toner charge amount of the developer, the print number is obtained but the information may also be a time (image forming time) when the image formation is effected. Further, as the information correlating to the toner charge amount of the developer, an integrated value of the developing device driving time (total driving time of the developing sleeve) or an integrated value of a developing device drive amount (total number of turns of the developing sleeve) may also be used. That is, the toner charge amount of the developer correlates to the operating time of the developing device 4 and therefore as the information relating thereto, the time when the image formation is effected may be counted by the CPU 61. Also in this case, the Vback in the sheet interval may be made small with the increase of the operating time.

Second Embodiment

Second Embodiment of the present invention will be described with reference to FIGS. 9 to 13. Incidentally, a basic constitution and operation of the image forming apparatus in this embodiment are the same as those in First Embodiment described above. Therefore, elements having the same or corresponding functions and constitutions are represented by the same reference numerals or symbols as those in First Embodiment and will be omitted from detailed description. In the following, a different portion will be principally described.

In this embodiment, as the information correlating to the toner charge amount of the developer in the developing container, a toner content or concentration (developer content) in each of the developing containers for yellow, magenta, cyan and black is detected. For this purpose, as shown in FIG. 9, each of the developing devices 4 is provided with a (magnetic) permeability sensor 42 as a toner content detecting means. Further, depending on a detection result of the permeability sensor 42 and the sheet interval time, the Vback setting in the sheet interval is determined.

As shown in FIG. 9, to the developing container 44, in a stirring chamber 44*b*, the permeability sensor 42 as the toner content detecting means for detecting the toner content (a mixing ratio between the toner and the carrier) is attached. The permeability sensor 42 is provided on a side wall of the developing means container 44 upstream of a toner supply opening 44*c* with respect to a developer feeding direction in the stirring chamber 44*b*.

Assuming that the position in which the toner is supplied from the toner supplying device 49 is on the most upstream side in terms of the developer circulation, the position to which the toner content detecting sensor 42 is attached is the most downstream side. In other words, the toner content detecting sensor 42 is positioned so that it can detect the content of the developer in the most stirred state.

Next, toner supply control of the inductance detection type employed in this embodiment will be described. As described above, the amount of the toner in the developing container 44 reduced since the toner is consumed by an image forming operation. For that reason, the toner content in the developer in reduced. In this embodiment, the developing container 44 of the developing device 4 is provided with the permeability sensor 42, which is for detecting the permeability of the developer in the developing container 44 to detect the toner content of the developer in the developing container 44. The smaller the toner content in the developer, the larger the carrier ratio, and therefore, the permeability of the developer is increased. Thus, the output level of the permeability sensor 42 is increased.

As shown in FIG. 10, the permeability sensor 42 has a shape such that a cylindrical detection head 42*a* is mounted on and integrated with a body portion 42*c*. The permeability sensor 42 transfers its detection signals with the CPU 61 of the engine controller 60, provided in the main assembly of the image forming apparatus, through an input/output signal wire 42*b*. In the detection head 42*a*, a detection transformer is embedded. This detection transformer is made up of a total of three coils consisting of a single primary coil and two secondary coils which consist of a referential coil and a detection coil. The detection coil is disposed on the top surface side of the detection head 42*a*, and the referential coil is disposed on the rear side of the detection head 42*a*, with the primary coil located between the two secondary coils.

When electric current with a certain waveform signal is inputted into the primary coil from an oscillator provided in the sensor body portion 42*c*, the electric current with the certain waveform signal flows through the two secondary coils consisting of the referential coil and the detection coil by electromagnetic induction. Then, the density of the magnetic substance on the top surface side of the body portion 42*c* of the sensor is detected by comparing the certain waveform signal from the oscillator, with the use of a comparator circuit provided in the body portion 42*c* of the sensor, with the electric current with the certain waveform signal, which is carried from the detection coil by the electromagnetic induction.

Here, the relationship between the toner content of the developer and the output of the permeability sensor 42 will be described. FIG. 11 shows an output characteristic of the permeability sensor 42. In the example shown in FIG. 11, when the developer is small in toner content, the output voltage becomes saturated at a large value, and as the developer increases in toner content, the sensor output gradually reduces. Further, when the developer is high in toner content, the output voltage saturates at a small value. In this embodiment, the permeability sensor 42 has been adjusted so that when the toner content is normal, that is, 8% (wt. %: hereafter, toner content will be expressed in wt. %), its output voltage value is 2.5 V. When the output voltage value is close to 2.5 V, the output voltage value of the permeability sensor 42 substantially linearly changes relative to the toner content. Incidentally, a target signal value of the permeability sensor 42 is changed to an optimal target value depending on the status of use of the developing device and a use environment.

As described above, the toner content of the developer in the developing container 44 is detected by the permeability sensor 42. Then, the toner supplying device 49 in which the toner for supply is stored is driven on the basis of the detection result of the permeability sensor 42, so that the toner content of the developer in the developing container 44 is kept constant. That is, on the basis of the detection result of the permeability sensor 42, the CPU 61 determines a rotation time of the motor 53 and rotates the motor 53 for the rotation time. In the ROM (or CPU 61), the information for obtaining from the detection output of the permeability sensor 42, the amount of the toner to be supplied to the developing container 44 on the basis of the relationship as shown in FIG. 11, is stored in the form of table data or the like. Therefore, the CPU 61 can control the toner supply amount, by obtaining the number of turns of the toner feeding screw 47 from the information and the table data as described above which shows a corresponding relation between the rotation time of the motor 53 and the amount of toner to be supplied.

Normally, in the toner supply control of the inductance detection type, each time the image forming operation for a single sheet of the material P is performed, the toner is supplied by obtaining the rotation time of the toner feeding screw 47. Incidentally, a target value of the toner content in this embodiment is, e.g., 8% for all the toners of yellow, magenta, cyan and black.

Next, the sheet interval control during the continuous image forming job in this embodiment will be described based on FIG. 12 while making reference to FIG. 6 described above. Also in this embodiment, the control is effected in the manner along the timing chart shown in FIG. 6. Incidentally, FIG. 12 is a table showing a relationship between the toner content of the developer and the set Vd for the Vback in the sheet interval.

In this embodiment, the switching of the developing DC bias in (b) of FIG. 6 is effected depending on the toner content of the developer in accordance with the table of FIG. 12. This point will be described. As a status in which the toner charge amount is lowered, there is the time when the toner content of the two-component developer in the developing container 44 is increased. That is, the proportion of the toner in the developing container 44 is increased, the toner is correspondingly less tending to charged, so that the toner charge amount is lowered. As a factor for the increase of the toner content, it is known that the increase of the toner content occurs in the case where non-uniformity of the toner supply amount occurs or in the case where the developer is charged up or in the like case.

That is, generally, the toner supply amount is controlled as described above, the toner content is, e.g., substantially kept at the target value but the toner content can be deviated largely from the target value in the case where the non-uniformity of the toner supply amount occurs or in the case where the developer is charged up. Specifically, when the toner supply amount fluctuates, the toner amount in the developing container 44 is temporarily increased, so that the toner charge amount can be lowered temporarily. Further, also in the case where the toner is charged up, the toner in a large amount is temporarily supplied in order to lower the toner charge amount, so that the toner charge amount is macroscopically lowered.

In either case, by the lowering of the toner charge amount, the above-described toner deposition on the developing sleeve 4*b* is liable to occur. Therefore, in this embodiment, the toner content is detected as the information on the toner charge amount and then the fog-removing potential is decreased, i.e., Vdc is increased, with the increase of the toner content. In this embodiment, the permeability sensor 42 for detecting the toner content corresponds to the charge amount information detecting means.

A series of control in this embodiment will be described with reference to FIG. 13. Incidentally, a basic flow is similar to that described above with reference to FIG. 8. In this embodiment, in S4, when the sheet interval time X is not less than 400 ms, the CPU 61 obtains, from the detection signal of the permeability sensor 42, the information on the toner content in the developing container 44 (S71).

Then, from the obtained toner content, the developing DC bias Vdc (for Vback) applied in the sheet interval is determined in accordance with the table of FIG. 12 (S8). Then, in the sheet interval, the developing device drive is once stopped and at the same time, the developing AC bias is turned off and the developing DC bias is switched to the value determined in S8 and then is applied to the developing sleeve 4*b* (S9). Other structures and functions are the same as those in First Embodiment described above.

Third Embodiment

Third Embodiment of the present invention will be described with reference to FIGS. 14 to 16. Incidentally, a basic constitution and operation of the image forming apparatus in this embodiment are the same as those in First Embodiment described above. Therefore, elements having the same or corresponding functions and constitutions are represented by the same reference numerals or symbols as those in First Embodiment and will be omitted from detailed description. In the following, a different portion will be principally described.

In this embodiment, as the information correlating to the toner charge amount of the developer in the developing container, the CPU 61 (FIG. 2) calculates, every predetermined print (copy) number, an average image duty for each of yellow, magenta, cyan and black. Then, depending on the calculated average image duty and the sheet interval time, the Vback setting in the sheet interval is determined.

In the image forming apparatus in this embodiment, a so-called vide count system (type) in which the toner consumption amount can be estimated from the vide count number for the image density of the image information signal read by a CCD or the like is employed. That is, a level of an output signal of an image signal processing circuit is counted every pixel and the counted number is integrated for pixels of an original paper size, so that the video count number per sheet of the original is obtained. For example, with respect to the A4 size, a maximum video count number per sheet is $3884\times10^6$ in the case of 400 dpi and 256 gradation levels. From this video count number and integration of the copy number, an average image duty J per job is calculated.

Next, the sheet interval control during the continuous image forming job in this embodiment will be described based on FIG. 14 while making reference to FIG. 6 described above. Also in this embodiment, the control is effected in the manner along the timing chart shown in FIG. 6. Incidentally, FIG. 14 is a table showing a relationship between the average image duty J and the set Vd for the Vback in the sheet interval.

First, after the copy (job) is started, when the copy number reaches a predetermined number (100 sheets in this embodiment), the average image duty J_100, for each of yellow, magenta, cyan and black, at the time of 100 sheets stored in the ROM 62 (FIG. 2) is calculated.

In this embodiment, the switching of the developing DC bias in (b) of FIG. 6 is effected depending on the average image duty J_100 in accordance with the table of FIG. 14. This point will be described. As a status in which the toner charge amount is lowered, there is the case where high-duty image formation is effected many times. When the high-duty image formation is effected many times, the toner is abruptly consumed, so that the toner in a large amount is temporarily supplied into the developing container 44 (FIG. 2).

That is, the amount of the toner consumed for development depends on the image duty. Therefore, the amount of the toner to be consumed is obtained from the average image duty at a predetermined print number. In this embodiment, on the basis of the image duty, the toner in an amount corresponding to the consumed toner amount is supplied into the developing container 44 by the toner supplying device 49 (FIG. 2). Therefore, with a higher average image duty, the toner consumption amount becomes larger, so that the toner supply amount is increased. When the toner supply amount is increased, there arises the case where the supplied toner is not completely charged sufficiently by the stirring (feeding) screws 4*c*1 and 4*c*2 (FIG. 2), so that the toner with low charge amount is conveyed by the developing sleeve 4*b* in some cases.

FIG. 15 shows a toner charge amount distribution, at each of image duties of 5%, 50% and 100%, when the image formation on 100 sheets is effected. Incidentally, the toner charge amount is negative and therefore the value toward the right hand in FIG. 15 means that the toner charge amount is lowered. As apparent from FIG. 15, the toner charge amount is lowered with a large image duty.

By the lowering of the toner charge amount, the above-described toner deposition on the developing sleeve 4*b* is liable to occur. Therefore, in this embodiment, the average image duty calculated from the image information signal is detected as the information on the toner charge amount and then the fog-removing potential is decreased, i.e., Vdc is increased, with the increase of the average image duty. In this embodiment, the CPU 61 for calculating the average image duty from the image information signal corresponds to the charge amount information detecting means.

A series of control in this embodiment will be described with reference to FIG. 16. Incidentally, a basic flow is similar to that described above with reference to FIG. 8. In this embodiment, in S4, when the sheet interval time X is not less than 400 ms, the CPU 61 calculates the average image duty J_100 at the print number of 100 sheets (S72), thus obtaining the calculated average image duty J_100 (S73). Then, from the obtained average image duty J_100, the developing DC bias Vdc (for Vback) applied in the sheet interval is determined in accordance with the table of FIG. 14 (S8). Then, in the sheet interval, the developing device drive is once stopped and at the same time, the developing AC bias is turned off and the developing DC bias is switched to the value determined in S8 and then is applied to the developing sleeve 4*b* (S9).

Incidentally, in this embodiment, as the information relating to the toner supply amount, the average image duty calculated from the image information signal was used. However, other than the use of the average image duty, the amount of the toner supplied by the toner supplying device 49 may also be actually calculated. For example, the toner supply amount is obtained when the number of turns of or a rotation time of the toner feeding screw 47 is counted. Other structures and functions are the same as those in First Embodiment described above.

Fourth Embodiment

Fourth Embodiment of the present invention will be described with reference to FIGS. 17 to 19. Incidentally, a basic constitution and operation of the image forming apparatus in this embodiment are the same as those in First Embodiment described above. Therefore, elements having the same or corresponding functions and constitutions are represented by the same reference numerals or symbols as those in First Embodiment and will be omitted from detailed description. In the following, a different portion will be principally described.

In this embodiment, by controlling a driving speed of the developing device in the sheet interval depending on the print number with respect to the developing device, the occurrence of the image defect such as the toner stripe is suppressed. That is, in this embodiment, the CPU 61 controls the driving speed (rotation speed) of the developing sleeve 4*b* in the following manner in the case where the surface of the photosensitive drum 2 (FIG. 2) is charged in the sheet interval (during the non-developing operation).

First, as shown in (a) of FIG. 17, in the case where the sheet interval time is short, each of the photosensitive drum drive, the charging bias, the developing device drive, the developing AC bias and the developing DC bias is kept in the "ON" state also in the sheet interval similarly as during the image formation. Further, the driving speed (rotational speed) is also kept as it is.

On the other hand, as shown in (b) of FIG. 17, in the case where the sheet interval time is long, the developing AC bias application is once stopped ("OFF") in the sheet interval, and the developing device drive is changed in accordance with a table shown in FIG. 18 described later. That is, the motor (FIG. 2) is controlled so that the driving speed of the developing sleeve 4*b* is not less than that during the image formation and is made higher with an increase of a degree of the tendency that the toner charge amount is lowered. In this embodiment, the information relating to the toner charge amount is, similarly as in First Embodiment described above, the print number counted by the CPU 61. Therefore, the CPU 61 also functions as the charge amount information detecting means.

In such case of this embodiment, in a state in which the toner charge amount is not lowered, the developing device drive in the sheet interval is stopped. On the other hand, with the decrease of the toner charge amount (with the increase of the print number), the developing device drive in the sheet interval is made faster. As a result, it is possible to suppress concentrated deposition, at the sleeve surface, of the toner present between the developing sleeve 4*b* and the photosensitive drum 2.

This will be described more specifically. In this embodiment, the driving speed of the developing sleeve 4*b* is set at 400 mm/sec during the normal image formation, and in the sheet interval, the developing AC bias application is once stopped and also the driving speed of the developing sleeve 4*b* in the sheet interval is changed in accordance with the table of FIG. 18. That is, in the sheet interval, the drive of the developing sleeve 4*b* is stopped or the driving speed of the developing sleeve 4*b* in the sheet interval is made lower than that during the image formation. This is because a developer deterioration and a developing device part deterioration are suppressed by stopping the drive of the developing sleeve 4*b* or by making the rotational speed (driving speed) lower than that during the image formation. Further, the reason why the developing AC bias is once stopped simultaneously with the stop of the developing device drive is that the developing AC bias is turned off to suppress movement (jumping) of the toner from the carrier and to suppress the deposition of the toner on the sleeve surface even in a slight amount.

Further, the reason why the driving speed of the developing sleeve 4*b* is made faster with the lowering of the toner charge amount is as follows. That is because the toner present between the developing sleeve 4*b* and the photosensitive drum 2 is less tending to be concentratedly deposited on the sleeve surface by increasing the driving speed of the developing sleeve 4*b*. In other words, the amount of the toner deposited in the same area of the developing sleeve 4*b* can be made small, and further in other words, the toner to be deposited can be dispersed.

A series of control in this embodiment will be described with reference to FIG. 19. Incidentally, a basic flow is the same as that described above with reference to FIG. 8. In this embodiment, when the sheet interval time X is not less than 400 ms (NO of S4), the CPU 61 obtains the print number (S7). Then, from the obtained print number, the driving speed of the developing sleeve 4*b* is determined in accordance with the table of FIG. 18 (S81). Then, in the sheet interval, the developing AC bias is turned off and the driving speed of the developing sleeve 4*b* is switched to the value determined in S81 (S91).

Thus, in the case where the sheet interval time is increased so as to be not less than the predetermined time (not less than 400 ms in this embodiment), simultaneously with the timing-off of the developing device drive in the sheet interval, the developing AC bias is turned off and the Vback is changed. As a result, even when the print number reached 100,000 sheets which was the exchange lifetime of the developing device, the image defect due to the toner charge amount lowering, such as fog or toner scattering, and defective image, such as a toner stripe, due to the toner deposition on the sleeve surface did not occur. On the other hand, the driving speed of the developing sleeve 4*b* is set at the same value through the print number corresponding to the lifetime of the developing device, in the latter half of the lifetime, the toner stripe due to setting such that the driving speed of the developing sleeve 4*b* cannot be set at a sufficiently large value occurred. Further, on the other hand, in the front half of the lifetime, due to setting such that the driving speed of the developing sleeve 4*b* is set at an excessively large value, excessive toner deterioration occurred.

As described above, in the sheet interval during the continuous image formation, the driving speed of the developing sleeve 4*b* in the sheet interval is changed depending on the print number. As a result, irrespective of the status of use of the developer, it is possible to suppress the occurrence of the image defect such as the toner stripe to effect stable image formation for a long term.

Incidentally, in this embodiment, in the case where the developing device drive is changed in the sheet interval during the continuous image formation, the developing AC bias is turned off but in this case, the developing AC bias may also be kept in the "ON" state.

Further, in this embodiment, as the information correlating to the toner charge amount of the developer, the print number is obtained but the information may also be a time when the image formation is effected. That is, the toner charge amount of the developer correlates to the operating time of the developing device 4 and therefore as the information relating thereto, the time when the image formation is effected may be counted by the CPU 61. Also in this case, the driving speed of the developing sleeve 4*b* in the sheet interval may be made high with the increase of the operating time.

Further, in this embodiment, depending on the status of use of the developer in the developing device, the driving speed of the developing sleeve 4*b* during the non-developing operation was controlled. However, there is of no problem even when the control of the fog-removing potential difference Vback during the non-developing operation depending on the status of use of the developer in the developing device as described in First Embodiment is used in combination with the control in this embodiment. Other structures and functions are the same as those in First Embodiment described above.

Fifth Embodiment

Fifth Embodiment of the present invention will be described with reference to FIGS. 20 and 21. Incidentally, a basic constitution and operation of the image forming apparatus in this embodiment are the same as those in Second and Fourth Embodiments described above. Therefore, elements having the same or corresponding functions and constitutions are represented by the same reference numerals or symbols as those in Second and Fourth Embodiments and will be omitted from detailed description. In the following, a different portion will be principally described.

In this embodiment, as the information correlating to the toner charge amount of the developer in the developing container, a toner content or concentration in each of the developing containers for yellow, magenta, cyan and black is detected. For this purpose, as described above with reference to FIG. 9, each of the developing devices 4 is provided with a (magnetic) permeability sensor 42 as a toner content detecting means. Further, depending on a detection result of the permeability sensor 42 and the sheet interval time, the driving speed of the developing sleeve 4*b* in the sheet interval is determined.

FIG. 20 is a table showing a relationship between the toner content in the developer and the set driving speed of the developing sleeve 4*b* in the sheet interval. In this embodiment, from the toner content detected by the permeability sensor 42, the driving speed of the developing sleeve 4*b* in the sheet interval by making reference to the table of FIG. 20 is determined. Incidentally, when the toner content is not more than 8%, the drive of the developing sleeve 4*b* is stopped.

A series of control in this embodiment will be described with reference to FIG. 21. Incidentally, a basic flow is similar to that described above with reference to FIGS. 13 and 19. In this embodiment, in S4, when the sheet interval time X is not less than 400 ms, the CPU 61 obtains, from the detection signal of the permeability sensor 42, the information on the toner content in the developing container 44 (S71). Then, from the obtained toner content, the driving speed of the developing sleeve 4*b* is determined in accordance with the table of FIG. 20 (S81). Then, in the sheet interval, the developing AC bias is turned off and the driving speed of the developing sleeve 4*b* is switched to the value determined in S81 (S91). Other structures and functions are the same as those in Second and Fourth Embodiments described above.

Sixth Embodiment

Sixth Embodiment of the present invention will be described with reference to FIGS. 22 and 23. Incidentally, a basic constitution and operation of the image forming apparatus in this embodiment are the same as those in Third and Fourth Embodiments described above. Therefore, elements having the same or corresponding functions and constitutions are represented by the same reference numerals or symbols as those in Third and Fourth Embodiments and will be omitted from detailed description. In the following, a different portion will be principally described.

In this embodiment, as the information correlating to the toner charge amount of the developer in the developing container, the CPU 61 (FIG. 2) calculates, every predetermined copy number (print number), the average image duty in each of the developing containers for yellow, magenta, cyan and black is detected. Further, depending on the calculated average image duty and the sheet interval time, the driving speed of the developing sleeve 4*b* in the sheet interval is determined.

FIG. 22 is a table showing a relationship between the average image duty J_100 and the set driving speed of the developing sleeve 4*b* in the sheet interval. In this embodiment, from the average image duty calculated from the image information signal, the CPU 61 determines the driving speed of the developing sleeve 4*b* in the sheet interval by making reference to the table of FIG. 20. Incidentally, when the average image duty is not more than 10%, the drive of the developing sleeve 4*b* is stopped. Here, the average image duty is also referred to as an average print ratio and is a ratio of the image portion occupied in a maximum image forming area of the recording material. The image duty is 100% for a solid black image and is 0% for a solid white image.

A series of control in this embodiment will be described with reference to FIG. 23. Incidentally, a basic flow is similar to that described above with reference to FIGS. 16 and 19. In this embodiment, in S4, when the sheet interval time X is not less than 400 ms, the CPU 61 obtains, the average image duty J_100 at the print number of 100 sheets (S72), thus obtaining the calculated average image duty J_100 (S73). Then, from the obtained average image duty J_100, the driving speed of the developing sleeve 4*b* is determined in accordance with the table of FIG. 20 (S81). Then, in the sheet interval, the developing AC bias is turned off and the driving speed of the developing sleeve 4*b* is switched to the value determined in S81 (S91). Other structures and functions are the same as those in Third and Fourth Embodiments described above.

Seventh Embodiment

Seventh Embodiment of the present invention will be described with reference to FIGS. 24 to 26. Incidentally, a basic constitution and operation of the image forming apparatus in this embodiment are the same as those in First Embodiment described above. Therefore, elements having the same or corresponding functions and constitutions are represented by the same reference numerals or symbols as those in First Embodiment and will be omitted from detailed description. In the following, a different portion will be principally described.

In this embodiment, depending on the print number with respect to the developing device, ON-timing of the developing device drive in the pre-rotation and OFF-timing of the developing device drive in the post-rotation are changed. That is, in this embodiment, different from the above-described embodiments, the time of the non-developing operation is not the sheet interval but is the time of the pre-rotation or the time of the post-rotation.

As described above with reference to FIG. 17, during the post-rotation (when the developing operation is stopped with the end of the image formation), in the case where the OFF-timing of the developing device and the OFF-timing of the charging/developing bias application are the same, the following state can be created. That is, a rise time of the developing device driving motor 51 (FIG. 2) is about several tens of msec (50 msec in this embodiment, whereas a falling time of the charging/developing bias takes several hundreds of msec (200 msec in this embodiment). For this reason, in a state in which the drive of the motor 51 is stopped, there is the case where the electric field (Vback) by which a force is exerted on the toner, on the developing sleeve 4*b* (FIG. 2), toward the developing sleeve 4*b* is generated.

In this state, in the case where the image formation is effected, the amount of the toner deposited on the developing sleeve 4*b* is increased and the above-described toner stripe occurring in the sheet interval can be generated. On the other hand, in the case where the OFF-timing of the developing device drive during the post-rotation is delayed, the rotation of the developing sleeve is stopped before the charging/developing bias is applied and therefore the toner fog occurs on the photosensitive drum 2 (FIG. 1).

Therefore, in this embodiment, the print number is counted similarly as in First Embodiment, and the OFF-timing of the developing device drive during the post-rotation is delayed with an increase of the print number. That is, during the post rotation (during the non-developing operation) in which the development by the developing device 4 is not effected, in the case where the surface of the photosensitive drum 2 is charged, an operating condition of the developing device 4 is controlled by the CPU 61 as the control means. Incidentally, FIG. 24 is a timing chart of the continuous image formation in this embodiment, and FIG. 25 is a table showing a relationship between the print number and drive timing setting of the developing sleeve 4*b*.

Here, in this embodiment, as an operation condition relation of the developing device 4, the OFF-timing of the drive of the developing sleeve 4*b* is delayed relative to the OFF-timing of the drive of the photosensitive drum 2. That is, as shown in FIG. 24, during the post-rotation, i.e., during the end of the image formation, the drive of the photosensitive drum 2 is stopped and the charging bias and the developing bias are turned off. At this time, the rotation of the developing sleeve 4*b* is continued. Further, after a lapse of a predetermined time Y (msec), the drive of the developing sleeve 4*b* is stopped (i.e., the motor 51 is stopped).

Further, the predetermined time Y is determined depending on the print number. That is, the predetermined time Y is increased with an increase of the print number. The predetermined time Y is determined by the table of FIG. 25. Thus, with the toner charge amount lowing statue, i.e., with the increase of the print number, the OFF-timing of the developing device drive in the post-rotation is delayed, so that it is possible to suppress concentrated deposition of the toner present between the developing sleeve 4*b* and the photosensitive drum 2.

That is, because the toner present between the developing sleeve 4*b* and the photosensitive drum 2 is less tending to be concentratedly deposited on the sleeve surface by delaying drive stop timing of the developing sleeve 4*b* than drive stop timing of the photosensitive drum 2. In other words, the amount of the toner deposited in the same area of the developing sleeve 4*b* can be made small, and further in other words, the toner to be deposited can be dispersed.

On the other hand, in the case where the developing device drive ON/OFF timing in the post-rotation was set at the same timing throughout the lifetime sheet number of the developing device, the toner stripe occurred in the latter half of the lifetime of the developing device. Further, on the other hand, in the front half of the developing device lifetime, the developing device drive was excessively effected, so that excessive toner consumption occurred.

A series of control in this embodiment will be described with reference to FIG. 26. When image formation (copying job) is started, the CPU 61 obtains the print number (S21). Then, the predetermined time Y is determined from the obtained print number in accordance with the table of FIG. 25 (S22). Then, the image formation is executed and the pre-rotation is started (S23). After the copying job is ended, the post-rotation is executed and on the basis of the predetermined time Y determined in S22, the drive OFF-timing of the developing sleeve 4*b* is delayed (S24).

As described above, the developing device drive OFF-timing during the post-rotation is changed depending on the print number. As a result, irrespective of the status of use of the developer, it is possible to suppress the occurrence of the image defect such as the toner stripe to effect stable image formation for a long term.

Incidentally, in this embodiment, depending on the print number, the developing device drive OFF-timing during the post-rotation is determined but as in Second and Fifth Embodiments, may also be determined by the toner content detected by the toner content sensor. Alternatively, as in Third and Sixth Embodiments, the developing device drive OFF-timing during the post-rotation may also be determined from the average image duty. In either case, the developing device drive OFF-timing is delayed with an increase of a degree of the tendency that the toner charge amount is lowered.

Further, in this embodiment, during the pre-rotation, the developing device drive ON-timing and the ON-timing of the charging/developing bias application were the same and therefore the toner stripe was not formed. On the other hand, during the pre-rotation, in the case where the developing device drive ON-timing is delayed than the ON-timing of the charging/developing bias application, the electric field (Vback) by which a force is exerted on the toner, on the developing sleeve, toward the developing sleeve in a state in which the developing device drive is stopped is generated. For this reason, the toner stripe is formed in some cases. Therefore, in such cases, as in the developing device drive control during the post-rotation in this embodiment, execution of control such that the developing device drive timing during the pre-rotation is advanced depending on the toner charge amount (status of use) of the developer in the developing container is also useful. Further, other than the change of the ON/OFF timing of the developing device drive, the change of the developing DC bias may also be made as described above in First to Third Embodiments.

Incidentally, the above-described respective embodiments can be carried out in appropriate combinations.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 281487/2010 filed Dec. 17, 2010, which is hereby incorporated by reference.

What is claimed is:

1. An image forming apparatus comprising:

an image bearing member;

a developing device for developing an electrostatic latent image formed on a surface of said image bearing member, wherein said developing device includes a developer carrying member for carrying a developer including a non-magnetic toner and a magnetic carrier and for conveying the developer to a developing position in which the developer carrying member opposes said image bearing member;

a sensor for detecting first information relating to a toner charge amount of the developer in said developing device; and a controller;

wherein an image forming period includes a first period in which an area, corresponding to a recording material, of a surface of said image bearing member passes through the developing position, and a second period in which an area, which does not correspond to the recording material, of the surface of said image bearing member passes through the developing position, wherein during a continuous image forming job, said controller effects, on the basis of second information relating to a conveyance interval between the recording material subjected to image formation and a subsequently-conveyed recording material, control so that a driving speed of the developer carrying member in the second period is lower than a driving speed of the developer carrying member in the first period or so that drive of the developer carrying member in the second period is stopped, and wherein said controller effects, on the basis of the first information and the second information, control so that a potential difference between a non-image-portion potential of said image bearing member and a developing bias applied to said developer carrying member is lower in the second period than in the first period.

2. An image forming apparatus according to claim 1, wherein the first information is a print number of sheets subjected to the image formation, and wherein said controller makes the potential difference, in a case where the print number is a first number, lower in the case where the print number is a second number higher than the first number.

3. An image forming apparatus according to claim 1, wherein the first information is a developer content in said developing device, and wherein said controller makes the potential difference, in a case where the developer content is a first content, lower in the case where the developer content is a second content more than the first content.

4. An image forming apparatus according to claim 1, wherein the first information is an average image duty, and wherein said controller makes the potential difference, in a case where the average image duty is a first image duty, lower in the case where the average image duty is a second image duty more than the first image duty.

5. An image forming apparatus according to claim 1, wherein the first information is an image forming time, and wherein said controller makes the potential difference, in a case where the image forming time is a first time, lower in the case where the image forming time is a second time more than the first time.

6. An image forming apparatus according to claim 1, wherein the first information is an integrated value of a number of turns of the developer carrying member, and wherein said controller makes the potential difference, in a case where the integrated value is a first integrated value, lower in the case where the integrated value is a second integrated value more than the first integrated value.

7. An image forming apparatus comprising:

an image bearing member;

a developing device for developing an electrostatic latent image formed on a surface of said image bearing member, wherein said developing device includes a developer carrying member for carrying a developer including a non-magnetic toner and a magnetic carrier and for conveying the developer to a developing position in which the developer carrying member opposes said image bearing member;

a sensor for detecting first information relating to a toner charge amount of the developer in said developing device; and a controller;

wherein an image forming period includes a first period in which an area, corresponding to a recording material, of a surface of said image bearing member passes through the developing position, and a second period in which an area, which does not correspond to the recording material, of the surface of said image bearing member passes through the developing position, wherein during a continuous image forming job, said controller is capable of executing, on the basis of second information relating to a conveyance interval between the recording material subjected to image formation and a subsequently-conveyed recording material, a mode in which a driving speed of the developer carrying member in the second period is lower than a driving speed of the developer carrying member in the first period, and wherein said controller changes, on the basis of the first information, a lowering amount of the driving speed of the developer carrying member in the second period relative to the driving speed of the developer carrying member in the first period.

8. An image forming apparatus comprising:

an image bearing member;

a developing device for developing an electrostatic latent image formed on a surface of said image bearing member, wherein said developing device includes a developer carrying member for carrying a developer including a non-magnetic toner and a magnetic carrier and for conveying the developer to a developing position in which the developer carrying member opposes said image bearing member;

a sensor for detecting first information relating to a toner charge amount of the developer in said developing device; and a controller for controlling drive stop timing of said developer carrying member when drive of the developer carrying member is stopped with an end of an image forming job, wherein said controller changes the drive stop timing of the developer carrying member relative to drive stop timing of said image bearing member on the basis of the first information.

9. An image forming apparatus according to claim 7, wherein the first information is a print number of sheets subjected to the image formation, and wherein said controller makes the lowering amount, in a case where the print number is a first number, lower in the case where the print number is a second number higher than the first number.

10. An image forming apparatus according to claim 7, wherein the first information is a developer content in said developing device, and wherein said controller makes the lowering amount, in a case where the developer content is a first content, lower in the case where the developer content is a second content more than the first content.

11. An image forming apparatus according to claim 7, wherein the first information is an average image duty, and wherein said controller makes the lowering amount, in a case where the average image duty is a first image duty, lower in the case where the average image duty is a second image duty more than the first image duty.

12. An image forming apparatus according to claim 7, wherein the first information is an image forming time, and wherein said controller makes the lowering amount, in a case where the image forming time is a first time, lower in the case where the image forming time is a second time more than the first time.

13. An image forming apparatus according to claim 7, wherein the first information is an integrated value of a number of turns of the developer carrying member, and wherein said controller makes the lowering amount, in a case where the integrated value is a first integrated value, lower in the case where the integrated value is a second integrated value more than the first integrated value.

14. An image forming apparatus according to claim 8, wherein the first information is a print number of sheets subjected to the image formation, and wherein said controller makes the drive stop timing of the developer carrying member relative to drive stop timing of said image bearing member, in a case where the print number is a first number, slower in the case where the print number is a second number more than the first number.

15. An image forming apparatus according to claim 8, wherein the first information is a developer content in said developing device, and wherein said controller makes the drive stop timing of the developer carrying member relative to drive stop timing of said image bearing member, in a case where the developer content is a first content, slower in the case where the print number is a second content more than the first content.

16. An image forming apparatus according to claim 8, wherein the first information is an average image duty, and wherein said controller makes the drive stop timing of the developer carrying member relative to drive stop timing of said image bearing member, in a case where the average image duty is a first image duty, slower in the case where the average image duty is a second image duty more than the first image duty.

17. An image forming apparatus according to claim 8, wherein the first information is an image forming time, and wherein said controller makes the drive stop timing of the developer carrying member relative to drive stop timing of said image bearing member, in a case where the image forming time is a first time, slower in the case where the image forming time is a second time more than the first time.

18. An image forming apparatus according to claim 8, wherein the first information is an integrated value of a number of turns of the developer carrying member, and wherein said controller makes the drive stop timing of the developer carrying member relative to drive stop timing of said image bearing member, in a case where the integrated value is a first integrated value, slower in the case where the integrated value is a second integrated value more than the first integrated value.

* * * * *